US006852459B2

(12) United States Patent
Katoh et al.

(10) Patent No.: US 6,852,459 B2
(45) Date of Patent: Feb. 8, 2005

(54) COLOR TONER, METHOD FOR MANUFACTURING THE TONER, AND IMAGE FORMING APPARATUS AND METHOD USING THE TONER

(75) Inventors: Kohki Katoh, Tokyo (JP); Masanori Suzuki, Suntou-gun (JP); Yohichiro Watanabe, Fuji (JP); Masahide Yamashita, Numazu (JP); Akihiro Kotsugai, Numazu (JP); Toyoshi Sawada, Odawara (JP); Keiko Shiraishi, Susono (JP)

(73) Assignee: Ricoh Company, Ltd., Yokohama (JP)

( * ) Notice: Subject to any disclaimer, the term of this patent is extended or adjusted under 35 U.S.C. 154(b) by 0 days.

(21) Appl. No.: 10/079,878

(22) Filed: Feb. 22, 2002

(65) Prior Publication Data

US 2003/0096183 A1 May 22, 2003

(30) Foreign Application Priority Data

Feb. 22, 2001 (JP) ..... 2001-046950

(51) Int. Cl.[7] ..... G03G 9/08

(52) U.S. Cl. ..... 430/108.4; 403/108.6; 403/108.8; 403/109.1; 403/109.4; 403/110.4; 403/126; 403/137.18

(58) Field of Search ..... 430/108.4, 137.18, 430/108.6, 108.1, 109.1, 109.4, 110.4

(56) References Cited

U.S. PATENT DOCUMENTS

| | | | | |
|---|---|---|---|---|
| 5,168,028 A | | 12/1992 | Nanya et al. | |
| 5,288,577 A | | 2/1994 | Yamaguchi et al. | |
| 5,368,972 A | | 11/1994 | Yamashita et al. | |
| 5,429,901 A | | 7/1995 | Muto et al. | |
| 5,554,471 A | * | 9/1996 | Bertrand et al. | 430/108.7 |
| 5,655,199 A | | 8/1997 | Yamashita et al. | |
| 5,774,775 A | | 6/1998 | Aoto et al. | |
| 5,863,690 A | | 1/1999 | Yamashita | |
| 5,873,018 A | | 2/1999 | Aoto et al. | |
| 5,882,832 A | | 3/1999 | Tosaka et al. | |
| 5,912,100 A | | 6/1999 | Aoki et al. | |
| 5,932,386 A | * | 8/1999 | Anno et al. | 430/108.9 |
| 6,004,715 A | | 12/1999 | Suzuki et al. | |
| 6,010,814 A | | 1/2000 | Kotsugai et al. | |
| 6,074,794 A | | 6/2000 | Fushimi et al. | |
| 6,074,795 A | | 6/2000 | Watanabe et al. | |
| 6,103,441 A | | 8/2000 | Tomita et al. | |
| 6,168,894 B1 | | 1/2001 | Aoki et al. | |
| 6,180,298 B1 | | 1/2001 | Kuroda et al. | |
| 6,183,926 B1 | | 2/2001 | Kuroda et al. | |
| 6,212,351 B1 | | 4/2001 | Kawagoe et al. | |
| 6,221,549 B1 | | 4/2001 | Emoto et al. | |
| 6,228,550 B1 | | 5/2001 | Matsuda et al. | |
| 6,232,030 B1 | * | 5/2001 | Otani et al. | 430/137.18 |
| 6,258,502 B1 | | 7/2001 | Nakamura et al. | |

(List continued on next page.)

FOREIGN PATENT DOCUMENTS

| | | | | |
|---|---|---|---|---|
| JP | 61-117565 | | 6/1986 | |
| JP | 61-156054 | | 7/1986 | |
| JP | 62-030259 | | 2/1987 | |
| JP | 62-127847 | | 6/1987 | |
| JP | 62-195677 | | 8/1987 | |
| JP | 62-280755 | | 12/1987 | |
| JP | 01-214874 | | 8/1989 | |
| JP | 02-066561 | | 3/1990 | |
| JP | 02-293866 | | 12/1990 | |
| JP | 02-293867 | | 12/1990 | |
| JP | 07-092726 | | 4/1995 | |
| JP | 07-128902 | | 5/1995 | |
| JP | 07-295242 | | 11/1995 | |
| JP | 07-311479 | | 11/1995 | |
| JP | 07-319208 | | 12/1995 | |
| JP | 08-015908 | | 1/1996 | |
| JP | 08-030014 | | 2/1996 | |
| JP | 08-220808 | | 8/1996 | |
| JP | 08-234483 | | 9/1996 | |
| JP | 09-106105 | | 4/1997 | |
| JP | 09-304964 | | 11/1997 | |
| JP | 09-304971 | | 11/1997 | |
| JP | 10-207116 | | 8/1998 | |
| JP | 10-254173 | | 9/1998 | |
| JP | 10-254-173 | | 9/1998 | |
| JP | 10-293425 | | 11/1998 | |
| JP | 11-002917 | | 1/1999 | |
| JP | 11-024313 | | 1/1999 | |
| JP | 11-249341 | | 9/1999 | |
| JP | 11258847 A | * | 9/1999 | G03G/9/08 |

OTHER PUBLICATIONS

Derwent MAT translation of JP 11–258847 (1999).*
U.S. Appl. No. 09/891,652, filed Jun. 26, 2001.
U.S. Appl. No. 09/843,357, filed Apr. 26, 2001.
U.S. Appl. No. 09/653,452, filed Aug. 31, 2000, allowed.
U.S. Appl. No. 09/862,436, filed May 23, 2001, pending.
U.S. Appl. No. 09/965,826, filed Oct. 1, 2001, pending.
U.S. Appl. No. 09/982,877, filed Oct. 22, 2001, pending.
U.S. Appl. No. 09/964,622, filed Sep. 28, 2001, pending.
U.S. Appl. No. 09/996,585, filed Nov. 30, 2001, pending.
U.S. Appl. No. 09/993,606, filed Nov. 27, 2001, pending.
U.S. Appl. No. 10/020,925, filed Dec. 19, 2001, pending.
U.S. Appl. No. 09/988,142, filed Nov. 19, 2001, pending.

(List continued on next page.)

*Primary Examiner*—Christopher Rodee
(74) *Attorney, Agent, or Firm*—Oblon, Spivak, McClelland, Maier & Neustadt, P.C.

(57) ABSTRACT

A color toner composition including at least toner particles including at least a binder resin; a colorant and a release agent dispersed in the binder resin; and a titania as an external additive, wherein the colorant has an average dispersion particle diameter not greater than 0.5 $\mu$m; the release agent and the binder resin are insoluble to each other; the toner particles satisfy the relationship: $0.05 \leqq Dw/D_4 \leqq 0.4$, wherein Dw represents an average dispersion particle diameter of the release agent and $D_4$ represents a weight-average particle diameter of the toner particles; and the titania has a segregation rate of from 0.5 to 5%.

15 Claims, 5 Drawing Sheets

U.S. PATENT DOCUMENTS

| | | | | | |
|---|---|---|---|---|---|
| 6,268,099 | B1 | * | 7/2001 | Eguchi et al. | 430/108.8 |
| 6,269,228 | B1 | | 7/2001 | Kayahara et al. | |
| 6,303,257 | B1 | | 10/2001 | Hasegawa et al. | |
| 6,303,258 | B1 | * | 10/2001 | Katoh et al. | 430/110.4 |
| 6,335,137 | B1 | | 1/2002 | Suzuki et al. | |
| 6,360,068 | B1 | | 3/2002 | Kinoshita et al. | |
| 6,363,229 | B1 | | 3/2002 | Shiraishi et al. | |
| 6,395,443 | B2 | | 5/2002 | Kuroda et al. | |
| 6,405,002 | B2 | | 6/2002 | Ogiyama et al. | |
| 6,406,826 | B1 | | 6/2002 | Suzuki et al. | |
| 6,432,589 | B1 | | 8/2002 | Uchinokura et al. | |
| 6,445,900 | B2 | | 9/2002 | Fukao et al. | |
| 6,449,453 | B1 | | 9/2002 | Motohashi | |
| 6,472,118 | B1 | | 10/2002 | Yamaguchi et al. | |
| 6,485,876 | B1 | * | 11/2002 | Takezawa et al. | 430/108.6 |
| 6,505,014 | B2 | | 1/2003 | Aoki et al. | |
| 6,505,024 | B2 | | 1/2003 | Kayahara et al. | |

OTHER PUBLICATIONS

U.S. Appl. No. 09/993,606, filed Nov. 27, 2001, pending.
U.S. Appl. No. 09/826,789.
U.S. Appl. No. 09/891,652.
U.S. Appl. No. 09/758,196, filed Jan. 12, 2001, allowed.
U.S. Appl. No. 09/713,201, filed Nov. 16, 2000, allowed.
U.S. Appl. No. 09/709,795.
U.S. Appl. No. 10/135,377, filed May 1, 2002, pending.
U.S. Appl. No. 10/114,056, filed Apr. 3, 2002, pending.
U.S. Appl. No. 10/077,752, filed Feb. 20, 2002, pending.
U.S. Appl. No. 10/102,867, filed Mar. 22, 2002, pending.
U.S. Appl. No. 10/020,925, filed Dec. 19, 2002, pending.
U.S. Appl. No. 10/077,813, filed Feb. 20, 2002, pending.
U.S. Appl. No. 10/098,556, filed Mar. 18, 2002, pending.
U.S. Appl. No. 09/985,368, filed Nov. 2, 2001, pending.
U.S. Appl. No. 09/985,347, filed Nov. 2, 2001, pending.
U.S. Appl. No. 09/903,718, filed Jul. 13, 2001, pending.
U.S. Appl. No. 09/942,574, filed Aug. 31, 2001, allowed.
U.S. Appl. No. 09/985,375, filed Nov. 2, 2001, pending.
U.S. Appl. No. 09/985,348, filed Nov. 2, 2001, pending.
U.S. Appl. No. 09/905,872, filed Jul. 17, 2001, pending.
U.S. Appl. No. 09/820,609, filed Mar. 30, 2001, pending.
U.S. Appl. No. 09/734,718, filed Dec. 13, 2000, allowed.
U.S. Appl. No. 09/692,430, filed Oct. 20, 2000, allowed.
U.S. Appl. No. 10/176,578, filed Jun. 24, 2002, pending.
U.S. Appl. No. 09/965,826, filed Oct. 1, 2001, pending.
U.S. Appl. No. 09/964,622, filed Sep. 28, 2001, pending.
U.S. Appl. No. 09/985,738, filed Nov. 11, 2001, pending.
U.S. Appl. No. 10/059,239, filed Jan. 31, 2002, pending.
U.S. Appl. No. 10/086,415, filed Mar. 4, 2002, pending.
U.S. Appl. No. 10/086,683, filed Mar. 4, 2002, pending.
U.S. Appl. No. 10/107,157, filed Mar. 28, 2002, pending.
U.S. Appl. No. 10/151,103, filed May 21, 2002, pending.
U.S. Appl. No. 10/212,736, filed Aug. 7, 2002, pending.
U.S. Appl. No. 10/112,769, filed Apr. 2, 2002, pending.
U.S. Appl. No. 10/188,049, filed Jul. 3, 2002, pending.
U.S. Appl. No. 10/188,753, filed Jul. 5, 2002, pending.
U.S. Appl. No. 10/092,920, filed Mar. 8, 2002, pending.
U.S.Appl. No. 10/158,069, filed May 31, 2002, pending.
U.S. Appl. No. 09/986,023, filed Nov. 7, 2001, pending.
U.S. Appl. No. 09/867,557, May 30, 2001.
U.S. Appl. No. 10/101,756, filed Mar. 21, 2002, pending.
U.S. Appl. No. 10/059,240, filed Jan. 31, 2002, pending.
U.S. Appl. No. 09/643,910, Aug. 23, 2000.
U.S. Appl. No. 09/712,927, Nov. 16, 2000.
U.S. Appl. No. 09/661,444, filed Sep. 13, 2000, allowed.
U.S. Appl. No. 10/284,177, filed Oct. 31, 2002, pending.
U.S. Appl. No. 10/102,629, filed Mar. 22, 2002, pending.
U.S. Appl. No. 09/826,789, Apr. 2001.
U.S. Appl. No. 09/910,080, filed Jul. 23, 2001, allowed.
U.S. appl. No. 09/943,505, filed Aug. 31, 2001, pending.
U.S. Appl. No. 09/945,839, filed Sep. 5, 2001, pending.
U.S. Appl. No. 09/948,576, filed Sep. 10, 2001, pending.
U.S. Appl. No. 09/963,644, filed Sep. 27, 2001, pending.
U.S. Appl. No. 09/984,236, filed Oct. 29, 2001, pending.
U.S. Appl. No. 09/983,687, filed Oct. 25, 2001, pending.
U.S. Appl. No. 09/987,027, filed Nov. 13, 2001, allowed.
U.S. Appl. No. 10/041,582, filed Jan. 10, 2002, pending.
U.S. Appl. No. 10/050,959, filed Jan. 22, 2002, pending.
U.S. Appl. No. 10/050,955, filed Jan. 22, 2002, pending.
U.S. Appl. No. 10/054,993, filed Jan. 25, 2002, pending.
U.S. Appl. No. 10/073,237, filed Feb. 13, 2002, allowed.
U.S. Appl. No. 10/075,402, filed Feb. 15, 2002, pending.
U.S. Appl. No. 10/083,159, filed Feb.27, 2002, pending.
U.S. Appl. No. 10/107,249, filed Mar. 28, 2002, pending.
U.S. Appl. No. 10/143,928, filed May 14, 2002, pending.
U.S. Appl. No. 10/152,672, filed May 23, 2002, pending.
U.S. Appl. No. 10/268,830, filed Oct. 11, 2002, pending.
U.S. Appl. No. 09/696,959, filed Oct. 27, 2000, allowed.
U.S. Appl. No. 09/947,391, filed Sep. 7, 2001, pending.
U.S. Appl. No. 09/960,922, filed Sep. 25, 2001, pending.
U.S. Appl. No. 10/104,078, filed Mar. 25, 2002, pending.
U.S. Appl. No. 10/151,109, filed May 21, 2002, pending.
U.S. Appl. No. 10/282,039, filed Oct. 29, 2002, pending.
U.S. Appl. No. 10/163,530, filed Jun. 7, 2002, pending.
U.S.Appl. No. 10/314,241, filed Dec. 9, 2002, pending.
U.S. Appl. No. 10/385,719, filed Mar. 12, 2003, Sugiura et al.
U.S. Appl. No. 10/394,265, filed Mar. 24, 2003, Nanya et al.
U.S. Appl. No. 10/391,575, filed Mar. 20, 2003, Suzuki et al.
U.S. Appl. No. 10/706,113, filed Nov. 13. 2003, Tanaka et al.
U.S. Appl. No. 10/726,669, filed Dec. 4, 2003, Kotsugai et al.
U.S. Appl. No. 10/712,026, filed Nov. 14, 2003, Tomita et al.
U.S Appl. No. 10/759,197, filed Jan. 20, 2004, Emoto et al.
U.S. Appl. No. 10/766,874, filed Jan. 30, 2004, Yamashita et al.
U.S. Appl. No. 10/772,435, filed Feb. 6, 2004, Dhiraishi et al.
U.S. Appl. No. 10/798,871, filed Mar. 12, 2004. Suzuki et al.
U.S. Appl. No. 10/804,082, filed Mar. 19, 2004, Tanaka et al.
U.S. Appl. No. 10/802,866, filed Mar. 18, 2004, Saito et al.
U.S. Appl. No. 10/802,887, filed Mar. 18, 2004, Tanaka et al.
U.S. Appl. No. 10/800,636, filed Mar. 16, 2004, Hasegawa et al.
U.S. Appl. No. 10/802/754, Yamaguchi et al., filed Mar. 18, 2004.

* cited by examiner

COLOR TONER, METHOD FOR MANUFACTURING THE TONER, AND IMAGE FORMING APPARATUS AND METHOD USING THE TONER

BACKGROUND OF THE INVENTION

1. Field of the Invention

The present invention relates to a toner used for electrophotographies, electrostatic recording methods, electrophotographic printings, etc., and more particularly to a color toner including a titania as an additive and a release agent, which has good transparency, color reproducibility, fluidity, fixability, offset resistance, and durability without filming, and which can be used for a fixer that does not use an oil in its fixing member. In addition, the present invention relates to a method for manufacturing the toner, and to an image forming apparatus and method using the toner.

2. Discussion of the Background

As background electrophotographic methods, various methods are disclosed in U.S. Pat. No. 2,297,691, Japanese Patent Publications Nos. 42-23910 and 43-24748, etc. Typically, in such methods an electrostatic latent image is formed on a photoconductive substrate using a photoconductive material and the latent image is developed with a toner to visualize the image, or optionally the toner image is transferred onto a paper, etc. and fixed by heating, pressurizing, or solvent steaming to form the visual image. As a full-color electrophotographic method to form a multi-color image, U.S. Pat. No. 2,962,374 discloses a method in which an image is irradiated with at least blue, green, and red color signals and the resultant latent image is developed repeatedly with a process color toner such as at least a yellow, a magenta, a cyan toner, etc. to multiply each color toner image to form a multi-color image.

Recently, hard copy technologies using the electrophotographic methods are rapidly developing into full-color copy technologies from mono-color technologies, and the full-color copy market is quickly expanding. The full-color electrophotographic methods typically reproduce all colors using three primary color toners, i.e., a yellow, a magenta, and a cyan color toner, or four colors including a black color toner. The typical method includes steps (1)–(3) as follows:

(1) a latent image is formed on a photoconductive layer of the photoconductive substrate with light from an original through a color-separation optical-transmission filter having a complementary color with the toner color;

(2) the latent image is developed with the toner and transferred onto a receiving material on which the toner is retained; and (3) the above-mentioned processes are repeated, and the toners are multiplied on the same receiving material while the registration is adjusted to form the final full-color image by only one-time fixation.

In such a full-color electrophotographic method that performs plural development and multiplies different color toner images on the same receiving material, the fixability of the color toner is quite an important factor. Namely, the fixed color toner needs to prevent the irregular reflections by the toner particles as much as possible and needs adequate glossiness. In addition, the color toner needs to have transparency not to prevent seeing the color tone of the toner in the underlayer of the toner layers, and good color reproducibility.

Typically, the color toner is manufactured by kneading a binder resin and a colorant or optionally with other materials such as a charge controlling agent upon application of heat, pulverizing the cooled material, and classifying the pulverized material into particles having specified particle sizes.

As the colorant used for the color toner, organic pigment colorants having better light resistance and safety than dye colorants are typically used.

However, the organic pigment colorant forms agglomerated primary particles of the organic pigment in a drying process of manufacturing the pigment and the above-mentioned background color toner manufacturing method cannot dissolve the agglomeration. Therefore, the colorant is difficult to disperse in the binder resin and the agglomerated primary particles of the pigment remains in the toner. Accordingly, the transparency, the color reproducibility, the optical permeability in an OHP film, and the colorability of the resultant color toner largely deteriorate, and particularly this tendency remarkably appears in a color toner having a small particle diameter.

In order to solve this problem, Japanese Laid-Open Patent Publications Nos. 62-30259, 62-280755, 266561, 2-293866, 2-293867, etc. disclose a method in which the dispersion of an organic pigment in a toner is improved by using a modified pigment ordinarily called a master batch. The modified pigment is manufactured by kneading a dry organic pigment with a binder resin upon application of heat such that the concentration of the pigment is higher than that of an ordinary pigment used for a toner, and kneading the kneaded material further while diluting the kneaded material with a binder resin such that the resultant toner has an adequate pigment concentration. However, the agglomerated particles are still difficult to finely disperse until they do not affect the optical permeability of the toner even by using the above-mentioned method.

As the other method, a method in which the master batch is formed by dissolving and mixing the materials in, for example, a solvent and evaporating the solvent is disclosed in Japanese Laid-Open Patent Publications Nos. 61-117565 and 61-156054, etc. However, only agitating a liquid-solution mixture cannot sufficiently disperse a colorant due to insufficient shearing force.

In addition, Japanese Laid-Open Patent Publication No. 62-127847 discloses a method in which a dispersion liquid of fine particles of a phthalocyanine pigment prepared by an acid paste method or an acid slurry method is mixed in an organic liquid solvent with a binder resin without drying the dispersion liquid to uniformly disperse the fine particles of the phthalocyanine pigment in the binder resin. However, the method has a problem that a large quantity of the organic solvent is needed to dissolve the binder resin and that the pigment tends to reaggregate when removing the water and organic solvent.

Japanese Laid-Open Patent Publication No. 7-311479 discloses a method in which a pigment-dispersion resin has a different solubility parameter from that of a binder resin and cannot be mixed therewith, and which is prepared by mixing a paste of a pigment including in water in a liquid-solution of a resin for dispersing the pigment and heating the mixture to form a toner having good transparency, offset resistance, and preventing an intertwist of a receiving paper. However, since the binder resin and the resin to disperse the pigment have different solubilities from each other, the resultant toner has a high refraction index and does not have sufficient transparency.

On the other hand, an additive such as a silica is typically included in a toner to improve its properties such as fluidity, transferability, and developability. When the content of the additive is small, the fluidity of the toner deteriorates and the toner tends to adhere to each other, resulting in the occurrence of toner filming on a photoreceptor, image-transfer irregularity and white spots on a solid image, a hollow defect on a thin line image, background fouling, and an increase of toner scattering. Therefore, the content of the additive has to be increased, and particularly the content thereof has to be increased further for a toner having a small particle diameter to keep the coverage because the specific surface area of such a toner increases.

In order to decrease the mutual toner adherence causing the image-transfer irregularity and white spots in a solid image, and a hollow defect in a thin line image, increasing the molecular weight of the binder resin can be considered. However, the color toner typically needs more fixing heat than the black toner to melt and to have low viscosity for having glossiness and transparency, but resin having a large molecular weight has a high softening temperature and the viscosity does not decrease even when the fixing temperature is high. Therefore, the resultant toner does not have sufficient glossiness and transparency. In addition, an excessive addition quantity of the additive causes a toner-scattered image in a thin line image, and particularly when a thin line image is produced in a full-color image, the toner quantity increases because at least two or more color toners have to be multiplied and the tendency remarkably appears.

When only the silica is added to a toner, the chargeability of the toner largely depends on the environment and the charge of the toner increases because the silica itself has high charging capability. Particularly, toner having a small particle diameter tends to have an excessive charge due to the mutual friction of the toner because of its large specific surface area. In order to solve this problem, a surface-treated silica or a titania instead of the silica can prevent the excessive charge due to the friction and the dependence of the toner chargeability on the environment to maintain an adequate charge. However, the surface-treated silica cannot by itself sufficiently prevent the dependence of the toner chargeability on the environment, while the titania effectively prevents the dependence of the toner chargeability on the environment, but deteriorates the transparency and color reproducibility of the resultant toner. Particularly, the titania is typically added to a toner more than an ordinary silica because it has a larger specific gravity than the silica, and therefore the transparency, color reproducibility, toner scattering, and fixability of the resultant toner deteriorate further. Particularly, for color toner that has to be stable for a long time and to produce an image having high image quality and color reproducibility, the deterioration of the transparency and color reproducibility of the toner is not preferable because that is one of the largest factors in deteriorating the image quality.

On the other hand, although a fixer fixing the color toner has a member made of a material having good surface releasability, the surfaces of most members are coated with an oil. Coating a large quantity of the oil on the fixing member to increase the releasability causes an oil spot on a receiving paper and a cost increase. In addition, a space for a tank containing the oil is needed, resulting in a problem that the fixer is enlarged.

The reason why the oil is typically coated on the fixing member is as follows. The color toner typically needs more fixing heat than the black toner to melt and to have low viscosity for having glossiness and transparency. However, a toner having such a resin tends to decrease the intermolecular agglomeration when melted upon application of heat and to adhere to the fixing member when passing the member, resulting in occurrence of a high-temperature offset phenomenon. Therefore, in order to prevent the high-temperature offset phenomenon, an oil is typically coated on the fixing member to decrease the toner adherence thereto.

On the other hand, using an oilless toner is attempted without coating the oil on the fixing member. A method in which a release agent is dispersed in a toner is disclosed in Japanese Laid-Open Patent Publications Nos. 8-220808, 9-106105, 9-304964, 9-304971, 10-2071126, 10-207126, 10-254173, 10-293425, 11-2917, 11-24313, 11-249341, etc.

However, as for the color toner in which the release agent is dispersed, the toner does not have sufficient transparency because the release agent is present on the surface of the toner, and the fluidity of the toner also largely deteriorates. Further, the release agent has to sufficiently filter from the color toner having a low viscosity and the offset prevention is difficult. To the contrary, a toner having high viscosity such as a black toner has a high intermolecular agglomeration when melted upon application of heat and the offset can be prevented if only a small quantity of the release agent filters from the toner, but the toner is not sufficiently melted and does not have sufficient transparency, color reproducibility, and glossiness.

Because of the above-mentioned reasons, a color toner including a titania and a release agent, and having the following properties (1)–(4), has not been realized:

(1) good transparency, color reproducibility, fixability, and offset resistance;
(2) applicability to a fixer without using an oil on the fixing member;
(3) freedom from background fouling, toner scattering, toner filming, and image defects such as hollow defects, image-transfer irregularity and white spots; and
(4) capablity of producing images having stable image quality for a long time.

On the other hand, a cleaner is conventionally used to remove a residual toner from an image bearer, i.e., a photoreceptor, and to collect the toner. Further, many technologies to recycle the collected toner by the cleaner for development are suggested. In addition, recently a belt is used as a transferer, and it is also suggested that the residual toner on the belt is removed and recycled.

However, there are some problems to be considered when recycling the residual toner on the photoreceptor and the transferer for development. For example, when removing the residual toner from the photoreceptor, a blade is typically used to scrape the toner. On an area of the photoreceptor contacting the blade, the agglomerated toner due to the mutual adherence of the toner and fine particles of the toner due to the pulverization thereof tend to be formed, resulting in deterioration of the toner properties. Consequently, when such a toner is recycled for development, the deteriorated toner such as the agglomerated toner and the pulverized fine particles thereof occasionally causes an abnormal image such as a decrease of the image density, background fouling, and toner scattering.

This is considered to be caused by the toner tending to adhere to each other because the additive such as silica and titania to increase the surface fluidity of the toner is not uniformly adhered to the surface of the impacted toner, or the additive is released from or buried in the surface thereof. When such a toner is used for development, the toner having a large particle diameter adheres to the photoreceptor. Therefore, image-transfer irregularity and white spots on a solid and a halftone image, image-density deterioration, background fouling, and toner scattering occur, and images having stable image quality cannot be produced over a long time.

Japanese Patent No. 2636300 discloses a toner including a specific polyester including fatty acid diol as a binder resin used for a recyclable image forming method. However, the toner particles are easily broken by a mechanical force such as friction and agitation when transferred to the cleaning and developing portion because polyester including aliphatic diol is more flexible than polyester including aromatic diol and the glass-transition temperature tends to decrease. Therefore, the fine particles of the toner tend to be formed, causing background fouling of the resultant image, contamination inside the image forming apparatus by the toner, and deterioration of the developability. Further, the mutual toner adherence increases and tends to be agglomerated because the additive such as silica and titania is easily buried in the toner. In addition, the toner filming on the photoreceptor occurs and the fluidity and heat resistance of the toner deteriorate. Particularly, the tendency remarkably appears under a condition of high temperature and high humidity.

Japanese Laid-Open Patent Publication No. 8-234483 discloses a toner including polyester having specific properties as a binder resin, and inorganic fine particles having a specific quantity of free agglomerated particles and a volume-average primary particle diameter of from 5 to 50 nm. The quantity of the free agglomerated particles of the inorganic fine particles is defined as (1)–(3) as follows:

(1) the free agglomerated particles having a particle diameter not less than 47 $\mu$m are not greater than 0.05% by weight per 100% by weight of the toner;

(2) the free agglomerated particles having a particle diameter not less than 20 $\mu$m and less than 47$\mu$m are 0.05% by weight per 100% by weight of the toner; and (3) the free agglomerated particles having a particle diameter not less than 2 $\mu$m and less than 20 $\mu$m are not greater than 1.0% by number per 100% by number of the toner However, the free inorganic fine particles cause the toner filming on a photoreceptor. The agglomerated fine particles scratch the photoreceptor and the inorganic fine particles accumulate in the scratch to cause image defects such as white spots. In addition, image density deteriorates, and background fouling and toner scattering increase as time passes. Therefore, images having stable image quality cannot be produced over a long time.

Japanese Laid-open Patent publication No. 8-15908 discloses that a toner including specific polyester as a binder resin, to which inorganic fine particles having an average particle diameter not less than 30 nm and less than 100 nm are adhered, is used for a recyclable image forming method. The inorganic fine particles having a larger particle diameter than that of ordinary inorganic fine particles effectively prevent the inorganic fine particles from being buried in the surface of the toner. However, depending on the mixed and adhered conditions of an additive, the inorganic fine particles releasing from the toner increase and cause the toner filming on the photoreceptor and the developing sleeve. In addition, the toner from which the inorganic fine particles are releasing decreases the quantity of the adhered fine particles as time passes, and the toner particles adhere to each other. Therefore, agglomerated particles are formed when the toner is transferred to the photoreceptor. The inorganic fine particles having a larger particle diameter than that of the ordinary fine particles tend to scratch the photoreceptor, and the fine particles accumulate in the scratch causing image defects such as white spots.

In addition, other prior technologies are disclosed in Japanese Laid-Open Patent Publications Nos. 62-195677, 7-92726, 7-128902, 7-295242, 7-319208, 8-30014, 10-254173, etc.

Further, an image forming apparatus and method in which a toner image formed on a photoreceptor is transferred onto a receiving material such as paper through an intermediate transfer medium such as an intermediate transfer belt are known. Such an image forming apparatus and method are widely used in apparatuses forming color images. For example, four color toner images, i.e., a black (Bk), a yellow (Y), a magenta (M), and a cyan (C) color toner image, are transferred and multiplied sequentially on the intermediate transfer medium at first. The multiplied toner images of Bk, Y, M, and C are transferred from the intermediate transfer medium onto the receiving material at a time and fixed thereon to form a color image. Compared with a method in which a toner image is directly transferred onto a receiving material, the intermediate transfer medium has an advantage to improve problems such as color drifts when the toner images are multiplied and faulty transfers due to the difference of the receiving materials. This is an important reason why the intermediate transfer medium is used when forming a color image.

In addition, recently, a tandem type image forming apparatus and method are known, in which plural photoreceptors are arranged in parallel and an image developer is arranged for each photoreceptor. A singlecolor toner image is formed on each photoreceptor and each single-color toner image is sequentially transferred onto a receiving material such as paper to form a color image. Further, an image forming apparatus and method combining this tandem type method and the above-mentioned intermediate transfer method are used.

Particularly, in the image forming apparatus and method using the intermediate transfer medium, a roller transferer through a roller is typically used for the first transfer from the photoreceptor to the intermediate transfer medium and the second transfer therefrom to the receiving material. When the transfer is performed, the toner image is pressurized by the roller and the adherence of the toner to the photoreceptor, intermediate transfer medium, or the receiving material increases. In addition, the agglomeration of the toner increases the mutual toner adherence and a local point of the toner is strongly pressurized, and therefore the point is not transferred to cause hollow defects of the resultant image. Further, the toner filming on the photoreceptor or the intermediate transfer medium, particularly the hollow defects, are remarkably formed on the thin line images.

As the first transfer method from the photoreceptor to the intermediate transfer medium, an indirect pressing method in which the roller is arranged downstream of the photoreceptor and a direct pressing method in which the roller directly pressurizes the photoreceptor through the intermediate transfer medium are known. In the indirect pressing method, the roller is arranged downstream of the photoreceptor, and the distance and space between the photoreceptors have to be longer and larger than those of the direct pressing method to avoid the mutual influences of the photoreceptors. Particularly, in the image forming apparatus and method combining the tandem and intermediate transfer methods, a larger space is needed since the plural photoreceptors and image developers are arranged in parallel. Therefore, in order to downsize the apparatus and cut cost thereof, the diameter of the photoreceptor has to be smaller to shorten the distance between the photoreceptors.

Accordingly, the direct pressing method is typically used for the image forming apparatus and method combining the tandem and intermediate transfer methods. However, as mentioned above, the intermediate transfer medium directly pressurizes the photoreceptor in the direct pressing method and the adherence of the toner to the photoreceptor and the intermediate transfer medium increases. In addition, the agglomeration of the toner increases the mutual toner adherence and the toner has a local point strongly pressurized. Therefore, the point is not transferred to cause the hollow defects of the resultant image. Further, the toner filming on the photoreceptor and the intermediate transfer medium tends to occur.

SUMMARY OF THE INVENTION

Accordingly, an object of the present invention is to provide a color toner including a titania as an additive and a release agent and having beneficial properties.

As a further objective the beneficial properties include:

(1) good transparency, color reproducibility, fixability, and offset resistance;

(2) applicability to a fixer without using an oil on the fixing member;

(3) freedom from background fouling, toner scattering, toner filming, and image defects such as hollow defects, image-transfer irregularity, and white spots; and (4) capability of producing images having stable image quality for a long time, as well as a method for manufacturing the toner, an image forming apparatus, and an image forming method using the toner.

In addition, another object of the present invention is to provide a color toner capable of producing images having good image quality over a long time without image-transfer irregularity, image hollow defects, toner scattering, background fouling, and toner filming even in an image forming apparatus and method in which a toner collected from the image bearers, particularly such as a photoreceptor, intermediate transfer medium, and transfer belt, is recycled for development, as well as a method for manufacturing the toner, an image forming apparatus, and an image forming method using the toner.

Further, yet another object of the present invention is to provide a color toner capable of producing images having good image quality over a long time and having good transferability without image hollow defects and toner filming even in an image forming apparatus and method including an intermediate transfer medium and plural photoreceptors, as well as a method for manufacturing the toner, an image forming apparatus, and an image forming method using the toner.

Briefly these objects and other objects of the present invention as hereinafter will become more readily apparent can be attained by a color toner including at least toner particles including at least a binder resin, a colorant, and a release agent dispersed in the binder resin, and a titania as an external additive. The colorant has an average dispersion particle diameter not greater than 0.5 $\mu$m, the release agent and the binder resin are insoluble to each other, the toner particles satisfy the relationship:

$$0.05 \leqq Dw/D_4 \leqq 0.4,$$

wherein Dw represents an average dispersion particle diameter of the release agent and $D_4$ represents a weight-average particle diameter of the toner particles, and the titania has a segregation rate of from 0.5 to 5%.

The inventors of the present invention discovered, as a result of their investigations, that when the release agent and the binder resin are insoluble to each other, the average dispersion particle diameter of the colorant (Dc) in the color toner is not greater than 0.5 $\mu$m, and when the weight-average particle diameter of the color toner is $D_4$ and the average dispersion particle diameter of the release agent in the color toner is Dw and the following relationship is satisfied:

$$0.05 \leqq Dw/D_4 \leqq 0.4,$$

the offset resistance, transparency, color reproducibility of the toner, as well as image hollow defects and the toner filming, are highly improved. In addition, the inventors also discovered that when the above-mentioned relationship between the weight-average particle diameter of the color toner and the average dispersion particle diameter of the release agent in the color toner is satisfied, and the segregation rate of the titania is from 0.5 to 5%, the fluidity of the toner is improved and the filming of the release agent and the titania on the photoreceptor can be prevented, and the durability of the toner is highly improved. In addition, the background fouling, toner scattering, image hollow defects, and toner filming are also highly improved.

These and other objects, features, and advantages of the present invention will become apparent upon consideration of the following description of the preferred embodiments of the present invention taken in conjunction with the accompanying drawings.

BRIEF DESCRIPTION OF THE DRAWINGS

Various other objects, features; and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
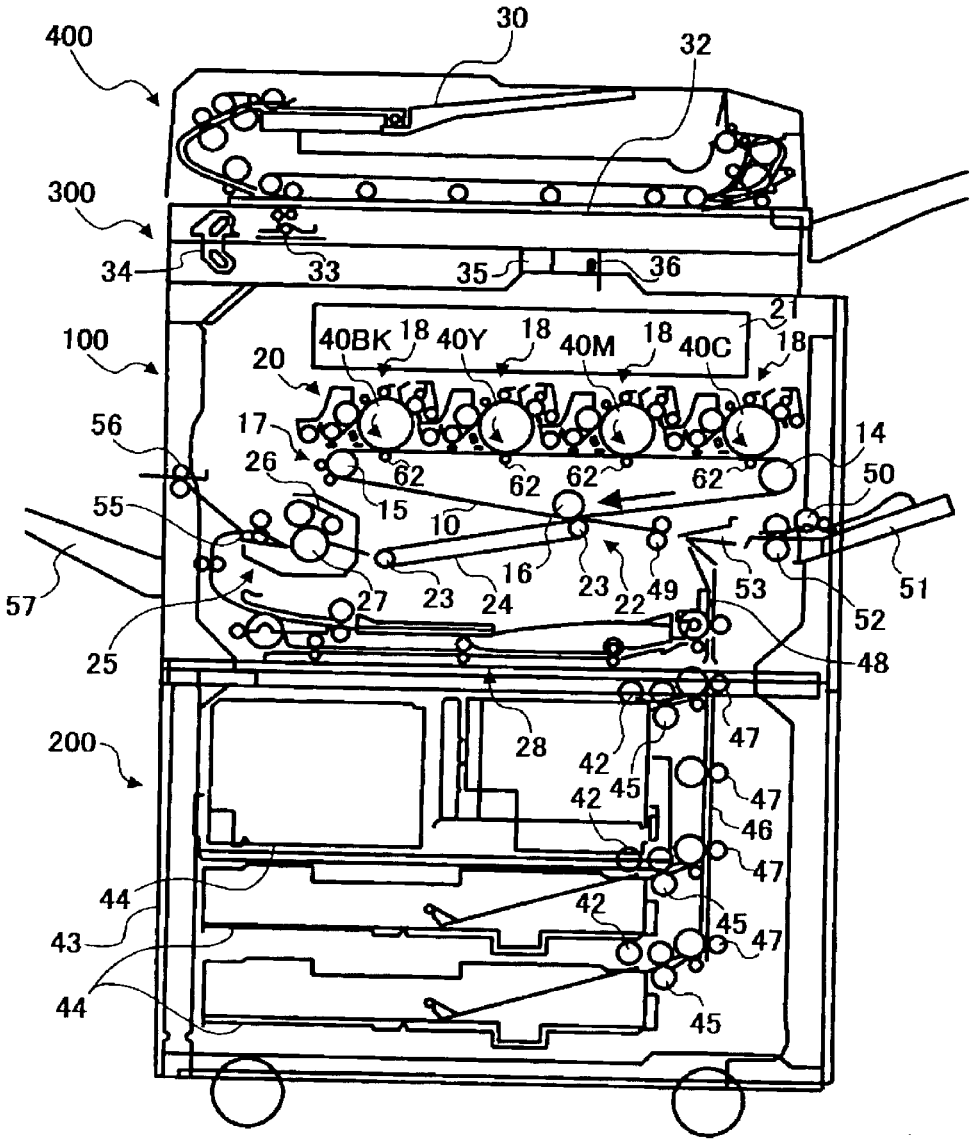
FIG. 1 is a schematic view illustrating an embodiment of the image forming apparatus of the present invention.

Generally, the present invention provides a color toner including at least toner particles including at least a binder resin, a colorant, and a release agent dispersed in the binder resin, and a titania as an external additive. The colorant has an average dispersion particle diameter not greater than 0.5 $\mu$m, the release agent and the binder resin are insoluble to each other, the toner particles satisfy the following relationship:

$$0.05 \leqq Dw/D_4 \leqq 0.4,$$

wherein Dw represents an average dispersion particle diameter of the release agent and $D_4$ represents a weight-average particle diameter of the toner particles, and the titania has a segregation rate of from 0.5 to 5%.

The reason for using a release agent that is insoluble to the binder resin is that the release agent filters from the surface of the toner when fixing and the toner has good fixability and sufficient offset resistance even if the fixing member is not coated with an oil. When the release agent is soluble to the binder resin, the transparency and color reproducibility are improved, but the offset tends to occur since the release agent does not filter from the surface of the toner.

At this point, when the average dispersion particle diameter of the colorant (Dc) in the color toner is not greater than 0.5 μm, and when the weight-average particle diameter of the color toner is $D_4$ and the average dispersion particle diameter of the release agent in the color toner is Dw, and the following relationship is satisfied:

$$0.05 \leq Dw/D_4 \leq 0.4,$$

it is found that particularly the offset resistance, transparency, and color reproducibility of the toner as well as image hollow defects and the toner filming, are highly improved.

Generally, when the dispersion particle diameter of the release agent is large, the resultant color toner has good offset resistance, but the transparency and the color reproducibility that are important properties of the color toner deteriorate. Therefore, the dispersion particle diameter of the release agent has to be small. However, although the toner including the release agent having a small dispersion particle diameter has good transparency and color reproducibility, the toner does not have sufficient releasability, fixability, and offset resistance. Accordingly, the average dispersion particle diameter of the release agent has to be fixed within a specific range, and when the average dispersion particle diameter of the colorant (Dc) in the color toner is not greater than 5 μm, and when the weight-average particle diameter of the color toner is $D_4$ and the average dispersion particle diameter of the release agent in the color toner is Dw, and the following relationship is satisfied:

$$0.05 \leq Dw/D_4 \leq 0.4,$$

it is found that particularly the offset resistance, transparency, and color reproducibility of the toner are highly improved.

This reason is not clear at present; however, one of the reasons is believed to be that the colorant having a dispersion particle diameter not greater than 0.5 μm in the toner improves its uniform dispersibility. The other reason is believed to be that when the above-mentioned relationship between the average dispersion particle diameter of the release agent in the toner and the weight-average particle diameter of the toner is satisfied, even the toners having different particle diameters have similar presentation on the surface thereof and solubility of the release agent. Therefore, the offset resistance, transparency, color reproducibility, as well as durability of the toner, are considered to be highly improved.

In addition, when the weight-average particle diameter of the color toner is $D_4$, the average dispersion particle diameter of the release agent in the color toner is Dw, and the following relationship is satisfied:

$$0.05 \leq Dw/D_4 \leq 0.4,$$

and the segregation rate of the titania used as an additive is from 0.5 to 5%, it is found that the resultant toner has good fluidity and resistance against background fouling, toner scattering, image hollow defects, and image-transfer irregularity. In addition, it is found that the filming of the release agent and titania on the photoreceptor can be prevented, and that the durability of the toner can be highly improved.

This is because the titania having a segregation rate of from 0.5 to 5% can decrease the free titania, improve the uniform adherence of the titania to the mother toner, and uniformly cover the release agent present on the surface of the toner.

When $Dw/D_4$ is less than 0.05, the resultant toner does not have sufficient releasability, fixability, and offset resistance.

When $Dw/D_4$ is greater than 0.4, the transparency, color reproducibility, as well as durability of the toner, deteriorate, and filming on the photoreceptor increases. In addition, image hollow defects, image-transfer irregularity, and white spots tend to occur.

In addition, when the average dispersion particle diameter of the colorant in the toner (Dc) is greater than 0.5 μm, the colorant is not sufficiently dispersed in the toner and the resultant toner does not have good transparency and color reproducibility. In addition, the charge distribution of the toner tends to be broad to cause background fouling and toner scattering, and particularly the tendency remarkably appears when the colorant having low chargeability is used.

The average dispersion particle diameters of the colorant and the release agent in the toner can be measured by various methods. In the present invention, the following method (1)–(5) is used:

(1) a prepared toner is hardened in a embedding resin;
(2) the hardened toner is sliced by Microtome MT-6000 manufactured by R.M.C. Inc. to have a thickness of 1100 Å;
(3) the sliced toner is observed by a transmission electron microscope JSM-800 manufactured by Jeol Ltd.;
(4) the dispersion particle diameters of 50 particles of the colorant and the release agent are measured by an image analyzer LUZEX500 manufactured by Nireco Corp. through a scanning converter unit; and
(5) the average values are determined as the average dispersion particle diameters.

As for the release agent, the average dispersion particle diameter is the average value of the major axis and minor axis. In addition, when the presence of the release agent is not observed, the release agent is judged to be dissolved in the binder resin.

In addition, the particle diameter of the toner can be measured by various methods, and a Coulter Multisizer is used in the present invention. Namely, Coulter Multisizer model IIe manufactured by Beckman Coulter, Inc., which an Interface manufactured by Nikkaki Bios Co., Ltd. and a personal computer are connected with is used, and an aqueos solution having 1% NaCl is prepared as an electrolyte using a first class natrium chloride. The measurement is performed by (1)–(4) as follows:

(1) from 0.1 to 5 ml of a detergent, preferably alkyl benzene sulfonate, is included as a disperser in the electrolyte having a volume of from 100 to 150 ml;
(2) a sample toner is included in the electrolyte to disperse the toner by an ultrasonic disperser for about from 1 to 3 min;
(3) the dispersed-sample liquid is included in the electrolyte having a volume of from 100 to 200 ml in a separate beaker until the dispersed-sample liquid has a predetermined concentration; and
(4) the average particle diameter of 50,000 particles is measured by the Coulter Multisizer IIe using an aperture having a diameter of 100 μm.

In addition, when the segregation rate of the titania is higher than 5%, the free titania adheres to the photoreceptor, developing roller, and the carrier to cause developing faults such as filming and insufficient cleaning, and image hollow defects, image-transfer irregularity, and white spots tend to occur.

Further, the free titania contaminates the surface of the carrier and decreases the charging capability thereof, and the developer is not sufficiently charged, resulting in occurrence of the background fouling, toner scattering, as well as deterioration of the developability.

In the toner having free titania, the adhered titania decreases as time passes and the uniform adherence of the titania to the mother toner decreases. Therefore, the titania cannot cover the release agent present on the surface of the toner. In addition, the mutual toner adherence increases to form the agglomerated particles and the fluidity of the toner deteriorates. Accordingly, image hollow defects, image-transfer irregularity, and white spots, as well as toner filming on the photoreceptor, tend to occur. Particularly, the tendency remarkably appears under a condition of high temperature and high humidity.

Particularly in an image forming apparatus and method in which the toner collected from the image bearers such as the photoreceptor, intermediate transfer medium, and transfer belt is recycled for development, the fluidity-deterioration of the toner decreases the transferability thereof to the developing portion. In addition, when transferred to the cleaning and developing portion, the toner receives mechanical forces such as friction and agitation and the toner further tends to be agglomerated. Therefore, when the recycled toner is mixed in the developing portion, the image-transfer irregularity, white spots, background fouling, and contamination in the apparatus by the toner become worse. Further, the heat resistance and developability of the toner deteriorate.

If the segregation rate of the titania is lower than 0.5%, the titania strongly adheres to the mother toner and is buried in the surface thereof. Therefore, the toner tends to be agglomerated and does not have sufficient fluidity, resulting in occurrence of image hollow defects, image-transfer irregularity, and white spots.

Particularly in an image forming apparatus and method in which the toner collected from the image bearers such as the photoreceptor, intermediate transfer medium, and transfer belt is recycled for development, the fluidity-deterioration of the toner decreases the transferability thereof to the developing portion. In addition, when transferred to the cleaning and developing portion, the toner receives mechanical forces such as friction and agitation and the toner further tends to be agglomerated. Therefore, when the recycled toner is mixed in the developing portion, the image-transfer irregularity, white spots, background fouling, and contamination in the apparatus by the toner become worse. Further, the heat resistance and developability of the toner deteriorate.

On the contrary, if the segregation rate of the titania is within 0.5 to 5%, the filming of the titania on the photoreceptor and the developing roller, and the adherence of the titania to the carrier, do not occur. In addition, the titania hardly decreases as time passes and agglomerated particles hardly increase. Therefore, the fluidity of the resultant toner is good and the durability thereof can be highly improved.

The segregation rate of the titania (Sr) can be measured by various methods. In the present invention, the rate is determined by the following formula using PT1000 manufactured by Yokogawa Electric Corp:

$$Sr=J^1/J^1+J^2\times 100(\%),$$

wherein $J^1$ represents the number of Ti elements that do not emit light at the same time when C elements emit light, and $J^2$ represents the number of Ti elements that emit light at the same time when C elements emit light.

The conditions of the measurement are as follows:

Analyzing wavelength:
- Ti elements: 334,900 nm;
- C elements: 247,860 nm;

Spectroscope used:
- Ti elements: No. 1 or No. 2 (blazed wavelength: 250 nm);
- C elements: No. 3 or No. 4 (blazed wavelength: 400 nm);

Measuring gas: $O_2$ 0.1% He gas;

The number of C elements detected by one scanning: from 500 to 1,000;

Noise cut level: not greater than 1.5;

Sorting time: 30 digits.

Even with surface-treated titania with a silane coupling agent, the segregation rate of the titania can be determined by the above-mentioned formula because the main components of the C elements are mother toners. The substantial addition quantity of the silane coupling agent is at most a few parts by weight, and the number of C elements detected from the silane coupling agent is practically a few compared with that from the mother toners.

In addition, when the weight-average particle diameter ($D_4$) and the number-average particle diameter (Dn) satisfy the following relationship:

$$D_4/Dn \leqq 1.3,$$

it is found that the offset resistance, transparency, color reproducibility, as well as the durability of the toner, can be highly improved. In addition, the background fouling, toner scattering, image hollow defects, and toner filming can be improved.

Generally, the toner has a particle diameter distribution, and the colorant cannot be uniformly dispersed with ease in the toner having a smaller particle diameter. The content ratio of the colorant in the toner having a small particle diameter tends to be lower than the ratio calculated from the actual input of the colorant. Also, the additive cannot easily adhere to the toner having a small particle diameter. When $D_4$/Dn is not greater than 1.3, preferably 1.25, and the fine-powder toner decreases, uniform dispersibility of the colorant in the toner and the uniform adherence of the additive thereto improves. In addition, the particle diameter distribution of the toner becomes sharp and the release agent is uniformly present on the surface thereof. Therefore, the background fouling, toner scattering, image hollow defects, and the toner filming on the photoreceptor decrease, and the offset resistance, transparency, color reproducibility, and durability are highly improved.

When $D_4$/Dn is greater than 1.3, the particle diameter distribution becomes broad, and the small particle-diameter toner that the additive cannot easily adhere to increases. The toner strongly adheres to the image bearers such as a photoreceptor and tends to be the residual toner, for example, on the photoreceptor, resulting in occurrence of the toner filming, agglomeration of the toner, background fouling, and toner scattering.

In addition, when $D_4$/Dn is greater than 1.3, in a system using a two-component developer including a toner and a carrier, the large particle-diameter toner having good developability is selectively developed and the small particle-diameter toner tends to remain in the image developer, resulting in deterioration of the developability and durability of the toner.

On the other hand, when a toner is used as a one-component developer in an image developer forming a thin toner layer on the toner transfer member, the toner layer thereon has to be as thin as possible to uniformly charge the toner. When $D_4/Dn$ is greater than 1.3, the toner present on the transfer member has a much smaller particle diameter than the toner supplied to the developing portion. As the development is repeated further, the particle diameter of the toner present in the hopper and on the transfer member gradually becomes large because the smaller particle-diameter toner is consumed first. Therefore, the initial chargeability of the toner becomes different as time passes, and the background fouling and image irregularity come to occur after images are continuously produced. Further, the chargeability of the toner on the toner transfer member and in the image developer is low and the large particle-diameter toner remains and accumulates thereon and therein, resulting in deterioration of the developability. Particularly, as for the color toner, the color tone fluctuates.

In addition, in developing a solid image, when $D_4/Dn$ is greater than 1.3, the small particle-diameter toner is present around the large particle-diameter toner in many cases. The small particle-diameter toner is difficult to transfer, causing image-transfer irregularity and white spots. Particularly, as for the color toner, a portion of an image on which the toner having a large particle diameter is fixed has high glossiness and a portion on which the toner having a small particle diameter is fixed has low glossiness. Namely, the glossiness differs according to the particle diameter of the toner developed, resulting in deterioration of the image quality due to the irregular glossiness.

The weight-average particle diameter ($D_4$) is preferably from 3 to 10 $\mu$m, and more preferably from 5 to 8 $\mu$m. When $D_4$ is less than 3 $\mu$m, background fouling occurs and fluidity of the toner deteriorates, resulting in hindrance of the toner supply and cleanability. When $D_4$ is greater than 10 $\mu$m, toner scattering occurs and image resolution deteriorates.

Any materials can be used for the release agent for use in the color of the present invention if it is insoluble to the binder resin. Specific examples of the release agent include: low molecular weight polyolefin waxes such as low molecular weight polyethylene and low molecular weight polypropylene; synthetic hydrocarbon waxes such as Fischer-Tropsch wax; natural waxes such as bees wax, carnauba wax, candelilla wax, rice wax, and montan wax; kerosene waxes such as paraffin wax and microcrystalline wax; higher fatty acids such as stearic acid, palmitin acid, and myristic acid; metallic salts of the higher fatty acids; higher fatty acid amide; and their various modified waxes. These can be used alone or in combination, and particularly the polyolefin wax and the de-free fatty acid carnauba wax can form a good release agent. The carnauba wax is preferably microcrystalline and has an acid value not greater than 5.

In addition, the melting point of the release agent is preferably from 75 to 105° C., and more preferably from 85 to 95° C.

When the melting point is lower than 75° C., offset and toner filming tend to occur and fluidity of the toner deteriorates. In addition, when the toner is stored, a blocking problem of the toner occurs. When the melting point is higher than 105° C., the resultant toner does not have sufficient fixability.

Particularly in an image forming apparatus and method in which the toner collected from the image bearers such as the photoreceptor, intermediate transfer medium, and transfer belt is recycled for development, the fluidity-deterioration of the toner decreases the transferability thereof to the developing portion. In addition, when transferred to the cleaning and developing portion, the toner receives mechanical forces such as friction and agitation and the toner further tends to be agglomerated. Therefore, when the recycled toner is mixed in the developing portion, image-transfer irregularity, white spots, background fouling, and contamination in the apparatus by the toner become worse. Further, heat resistance and developability of the toner deteriorate.

When the melting point is within the range of from 75° C. to 105° C., the release agent quickly melts when fixing the toner image and the toner has good fixability, offset resistance, and durability because of consistently performing its releasability.

The content of the release agent is from 1 to 10 parts by weight, and preferably from 2 to 5 parts by weight per 100 parts by weight of the binder resin. When the content is less than 1 part by weight, the offset resistance of the toner is not sufficient, and when greater than 10 parts by weight, fluidity, transferability, and durability of the toner deteriorate.

The melting point of the release agent is determined as follows.

Rigaku THERMOFLEX TG 8110 manufactured by RIGAKU Corp. is used at a programming rate of 10° C./min and the maximum peak of the endothermic curve is determined to be the melting point.

In addition, the ratio of the weight-average molecular weight (Mw) to the number-average molecular weight (Mn), i.e., Mw/Mn of the release agent for use in the color toner of the present invention is preferably from 1.0 to 1.2. When Mw/Mn is from 1.0 to 1.2, the toner has sufficient offset resistance because the release agent efficiently filters from the toner in fixing.

The molecular weight of the release agent is measured by a gel permeation chromatography method (1)–(2) as follows:

(1) a column is stabilized in a constant temperature bath having a temperature of 40° C.; and (2) 200 $\mu$l of tetrahydrofuran (THF) liquid solution having a sample concentration of 0.05 to 0.5% by weight included as an eluent in the column at a speed of 1 ml/min to measure the molecular weight.

The molecular weight of the sample is calculated from the molecular weight distribution determined from the retention time based on the previously prepared analytical curve. The analytical curve is prepared using several monodisperse polystyrene as the standard samples.

The analyzing column is Excelpak SEC-G14/G16/G18 manufactured by Yokogawa Analytical Systems Inc.

The titania used as an additive in the present invention preferably has an average primary particle diameter of from 0.002 to 0.03 $\mu$m, and more preferably from 0.005 to 0.02 $\mu$m in view of the transparency and fluidity of the resultant toner.

The titania having an average primary particle diameter less than 0.002 $\mu$m does not impair the transparency, but the agglomeration of the toner occurs because the titania is easily buried in the surface of the mother toner and the toner does not have sufficient fluidity. The tendency remarkably appears in the color toner melting quickly. Further, the toner filming on the image bearers such as the photoreceptor tends to occur particularly under a condition of high temperature and high humidity. In addition, the mutual agglomeration of the titania also occurs and the fluidity of the toner deteriorates.

Particularly in an image forming apparatus and method in which the toner collected from the image bearers such as the photoreceptor, intermediate transfer medium, and transfer belt is recycled for development, fluidity-deterioration of the toner decreases the transferability thereof to the developing portion. In addition, when transferred to the cleaning and developing portion, the toner receives mechanical forces such as friction and agitation and the toner further tends to be agglomerated. Therefore, when the recycled toner is mixed in the developing portion, the image-transfer irregularity, white spots, background fouling, and contamination in the apparatus by the toner become worse. Further, the heat resistance and developability of the toner deteriorate.

The titania having an average primary particle diameter less than 0.03 μm impairs the transparency, fixability, fluidity, and chargeability of the toner, resulting in occurrence of the background fouling and toner scattering. In addition, the titania causes a damage on the image bearers such as the photoreceptor, resulting in occurrence of the toner filming.

Particularly in an image forming apparatus and method in which the toner collected from the image bearers such as the photoreceptor, intermediate transfer medium, and transfer belt is recycled for development, the fluidity-deterioration of the toner decreases the transferability thereof to the developing portion.

The particle diameter of the titania can be measured by a transmission electron microscope.

The content of the titania is preferably from 0.3 to 1.5 parts by weight, and more preferably from 0.5 to 1.2 parts by weight per 100 parts by weight of the mother toner.

When the content of the titania is less than 0.3 parts by weight, the fluidity of the toner is not sufficient and the adherence of the toner to the non-image portion of the photoreceptor and the intermediate transfer medium increases, resulting in occurrence of the background fouling and image hollow defects. In addition, a uniform solid image cannot be produced because of the image-transfer irregularity and white spots.

Particularly in an image forming apparatus and method in which the toner collected from the image bearers such as the photoreceptor, intermediate transfer medium, and transfer belt is recycled for development, the fluidity-deterioration of the toner decreases the transferability thereof to the developing portion.

When the content of the titania is greater than 1.5 parts by weight, the fluidity of the toner is improved, but the transparency thereof deteriorates. Further, the cleaning defects of the photoreceptor due to the vibration and curl of the blade, and the filming of the titania released from the toner on the photoreceptor occur, resulting in deterioration of the durability of the cleaning blade and the photoreceptor, and of the fixability of the toner. In addition, the toner scattering occurs in a thin line image, and particularly when the thin line image is produced in a full-color image, the tendency remarkably appears because at least two or more color toners have to be multiplied.

The content of the titania is typically measured by a fluorescent X-ray analysis. Namely, an analytical curve is made on a toner including known content of the titania, and the content of the titania can be measured using the analytical curve.

Other additives besides the titania can be included in the toner of the present invention. Specific examples of the additives include oxides and complex oxides of Si, Al, Mg, Ca, Sr, Ba, In, Ga, Ni, Mn, W, Fe, Co, Zn, Cr, Mo, Cu, Ag, V, Zr, etc. Particularly, silica and alumina, which are oxides of Si and Al respectively, are preferably used.

Further, the surface of the additive for use in the present invention is preferably treated for being hydrophobized, improving the fluidity and controlling the chargeability, if desired.

Organic silane compounds are preferably used for the surface treatment. Specific examples of the organic silane compounds include alkylchlorosilane such as methylchlorosilane, octyltrichlorosilane, and dimethylchlorosilane; alkylmethoxysilane such as dimethylmethoxysilane and octyltrimethoxysilane; hexamethyldisilazane; and silicone oil.

As the methods for the treatment, the following methods (1)–(2) can be preferably used in the present invention:

(1) the additive is dipped in a liquid solution including organic silane compounds and dried; and (2) a liquid solution including organic silane compounds is sprayed on the additive and the additive is dried.

Other additives can be included in the toner of the present invention besides the above-mentioned additives. Specific examples of such additives include lubricants such as teflon, zinc stearate, and polyvinylidene fluoride; abrasives such as cerium oxide, silicon carbide, and strontium titanate; and conductivity imparting agents such as carbon black, zinc oxide, stibium oxide, and tin oxide.

The softening point of the binder resin used for the toner of the present invention is preferably from 80 to 110° C. When such a binder resin is used in the toner, the toner has low viscosity and is sufficiently melted when fixed. Therefore, the resultant toner has good transparency and color reproducibility.

When the softening point of the binder resin is lower than 80° C., the offset and blocking of the toner when stored tend to occur.

Particularly in an image forming apparatus and method in which the toner collected from the image bearers such as the photoreceptor, intermediate transfer medium, and transfer belt is recycled for development, the fluidity-deterioration of the toner decreases the transferability thereof to the developing portion. In addition, when transferred to the cleaning and developing portion, the toner receives mechanical forces such as friction and agitation and the toner further tends to be agglomerated. Therefore, when the recycled toner is mixed in the developing portion, the image-transfer irregularity, white spots, background fouling, and contamination in the apparatus by the toner become worse. Further, the heat resistance and developability of the toner deteriorate.

When the softening point of the binder resin is higher than 110° C., the resultant toner does not have sufficient glossiness and transparency.

The softening point of the binder resin is measured by (1)–(2) as follows:

(1) a sample having a volume of 1 $cm^3$ is melted and flows in an elevated flow tester CFT-500 manufactured by Shimadzu Corp. under the following conditions:

pore size: 1 mm;

pressure: 20 $kg/cm^2$;

programming rate: 6° C./min; and (2) the softening point is determined as a half of the temperatures when the sample starts and finishes flowing.

The binder resin used for the toner of the present invention is preferably a polyester resin, a polyol resin or a mixture of the polyester and the polyol resin because the toner having such a resin has good glossiness, transparency, and offset resistance. When two or more different kinds of resins are used, these resins are preferably soluble to each other when kneaded because the interface between the resins that are insoluble to each other refracts light to deteriorate the transparency of the resultant toner.

The mutual solubility of the binder resins is judged by observing with a transmission electron microscope.

Various polyester resins can be used in the present invention. The polyester resin formed from condensation polymerization of the following components is preferably used in the present invention:

(1) a diol component having the following formula (1):

(I)

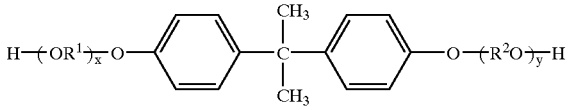

wherein $R^1$ and $R^2$ independently represent an alkylene group having 2 to 4 carbon atoms, x and y are positive integers, and the average sum of x and y is 2 to 16; and (2) a component selected from a group consisting of polybasic carboxylic acids having two or more carboxyl groups, their anhydrides, and their lower alkyl esters.

Specific examples of the diol components having the above-mentioned formula (I) include polyoxypropylene (2.2)-2,2-bis(4-hydroxyphenyl)propane, polyoxypropylene (2)-2,2-bis(4-hydroxyphenyl)propane, polyoxypropylene (6)-2,2-bis(4-hydroxyphenyl)propane, and polyoxypropylene(16)-2,2-bis(4-hydrpxyphenyl)propane. In addition, about 5 mol % or less of the following polyhydroxy compounds having two or more functional groups can be included in the diol components. Ethylene glycol, propylene glycol, glycerin, pentaerythritol, trimethylolpropane, hydrogenated bisphenol A, sorbitol or their etherized polyhdroxyl compounds.

Specific examples of the component selected from a group consisting of polybasic carboxylic acids having two or more carboxyl groups, their anhydrides and their lower alkyl esters include phthalic acid, isophthalic acid, terephthalic acid, maleic acid, fumaric acid and their anhydrides and lower alkyl esters, trimellitic acid or an acid including its anhydrides; and succinic acid derivatives such as n-dodecenyl succinic acid, n-dodecyl succinic acid, n-butyl succinic acid, iso-dodecenyl succinic acid and iso-octyl succinic acid. These acids improve the fixability at a low temperature and glossiness of the resultant toner.

In addition, various polyol resins can be used in the present invention. Particularly, the polyol resin formed from a reaction among $\hat{1}$ an epoxy resin; $\hat{2}$ an adduct of dihydric phenol with an alkylene oxide or its glycidyl ether, $\hat{3}$ a compound including an active hydrogen reacting with an epoxy group; and $\hat{4}$ a compound including two or more active hydrogen atoms reacting with an epoxy group. Further, $\hat{1}$ the epoxy resin preferably includes at least two or more kinds of bisphenol A, the number-average molecular weight of which are different from each other. The toner including the polyol resin has good glossiness, transparency and offset resistance.

The epoxy resin for use in the present invention is preferably formed from a combination of bisphenol such as bisphenol A and bisphenol F, and epichlorohydrin. The number-average molecular weight of the low and high molecular weight components of the epoxy resin is preferably from 360 to 2,000, and from 3,000 to 10,000 respectively. In addition, the contents of the low and high molecular weight components are preferably from 20 to 50% by weight, and from 5 to 40% by weight respectively. When the content of the low molecular weight components is too large or the molecular weight is lower than 360, it is probable that the resultant image is too glossy and the storage stability of the toner deteriorates. When the content of the high molecular weight components is too large or the molecular weight is higher than 10,000, it is probable that the resultant toner does not have sufficient glossiness and the fixability thereof deteriorates.

Specific examples of $\hat{2}$ the adducts of dihydric phenol with alkylene oxides for use in the present invention include reaction products of ethylene oxide, propylene oxide butylene oxide and their mixtures; and bisphenol such as bisphenol A and bisphenol F. The adducts may be glycidylated with epichlorohydrin, β-methylepichlorohydrin, etc. Particularly, a glycidyl ether having the following formula (II), which is an adduct of bisphenol A with an alkylene oxide.

(II)

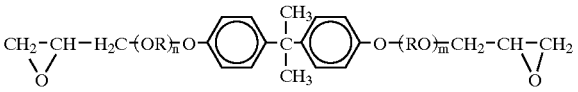

wherein R represents a $—CH_2—CH_2—$, a $—CH_2—CH(CH_3)—$ or a $—CH_2—CH_2—CH_2—$ group; and n and m are integers, not less than 1 respectively and n+m=2 to 6.

The content of the adduct of dihydric phenol with an alkylene oxide or its glycidyl ether is preferably from 10 to 40% by weight per 100% by weight of the polyol resin. When the content is too small, the number of curled receiving materials increases. When the content is too large or n+m is not less than 7, it is probable that the resultant image is too glossy and the storage stability of the toner deteriorates.

Specific examples of $\hat{3}$ the compound including an active hydrogen reacting with an epoxy group include monohydric phenol such as phenol, cresol, isopropylphenol, aminophenol, nonylphenol, dodecylphenol, xylenol, and p-cumylphenol; secondary amine such as diethylamine, dipropylamine, dibutylamine, N-methyl(ethyl)piperazine, and piperidine; and carboxylic acids such as propionic acid and caproic acid.

Specific examples of $\hat{4}$ the compound including two or more active hydrogen reacting with an epoxy group include dihydric phenol such as bisphenol A and bisphenol F; polyhydric phenol such as orthocresol novolaks, phenol novolaks, tris(4-hydroxyphenyl)methane, and 1-[α-methyl-α-(4-hydroxyphenyl)ethyl] benzene; polyhydric carboxylic acids such as malonic acid, succinic acid, glutaric acid, adipic acid, maleic acid, fumaric acid, terephthalic acid, trimellitic acid, and trimellitic anhydride.

When the polyester and polyol resins have high degree of crosslinking, it is difficult for the resultant toner to have transparency and glossiness and it is preferable that the resins are not crosslinked or slightly crosslinked, i.e., the insoluble components to tetrahydrofuran are not greater than 5%.

In addition, the following resins can be optionally used as the binder resin for use in the present invention. Polymers of styrene and its substituents such as polystyrene, polyp-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methylacrylate copolymers, styrene-ethylacrylate copolymers, styrene-butylacrylate copolymers, styrene-octylacrylate copolymers, styrene-methylmethacrylate copolymers, styrene-ethylmethacrylate copolymers, styrene-butylmethacrylate copolymers, styrene-α-methylchloromethacrylate copolymers, styrene-acrylonitrile copolymers, styrene-vinylmethylether copolymers, styrene-vinylethylether copolymers, styrene-vinyl methyl ketone copolymers, styrene-butadiene copolymers, styrene-isoprene copolymers, styrene-acrylonitrile-indene copolymers, styrene-maleic acid copolymers and styrene-ester maleate copolymers; polymethacrylate, polybutylmethacrylate, poly vinyl chloride, poly vinyl acetate, polyethylene, polypropylene, polyurethane, polyamide, eposxy resins, polyvinylbutyral, polyacrylate resins, rosin, modified rosin, terpene resins, phenol resins, etc.

As the colorant used for the toner of the present invention, known dyes and pigments can be used.

Specific examples of the yellow colorants include Naphthol yellow s, Hansa yellow (10G, 5G and G), Cadmium Yellow, yellow iron oxide, loess, chrome yellow, Titan yellow, polyazo yellow, Oil Yellow, Hansa Yellow(GR, A, RN and R), Pigment yellow L, Benzidine Yellow(G and GR), Permanent Yellow (NCG), Vulcan Fast Yellow (5G and R), Tartrazine Lake, Quinoline Yellow Lake, Anthrazane Yellow-BGL, benzimidazolone yellow, isoindolinone yellow, etc.

Specific examples of the red colorants include colcothar, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red(F2R, F4R, FRL, FRLL and F4RH), Fast Scarlet VD, Vulcan Fast Rubine B, Brilliant Scarlet G, Lithol Rubine GX, Permanent Red(FSR and FBB), Brilliant Carmine 6B, Pigment Scarlet 3B, Bordeaux 5B, Toluidine Maroon, Permanent Bordeaux F2K, Helio Bordeaux BL, Bordeaux 10 B, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, etc.

Specific examples of the blue colorants include cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chrome oxide, viridian, emerald green, pigment Green B, Naphthol Green B, Green Gold, Acid Green Lake, Malachite Green lake, Phthalocyanine green, Anthraquinone green, etc.

Specific examples of the blue colorants include azine pigments such as carbon black, oil furnace black, channel black, lamp black, acetylene black and aniline black; and metal salts of azo pigments, metal oxides, complex metal oxides, etc.

Specific examples of the other colorants include titania, Chinese white, lithopone, nigrosin dyes, iron black, etc.

These colorants can be used alone or in combination, and the content of the colorant is from 1 to 30 parts by weight, and preferably from 3 to 20 parts by weight per 100 parts by weight of the binder resin.

A charge controlling agent is preferably included in the toner of the present invention so as to properly charge the toner. It is preferable that the charge controlling agent is a transparent or white material so as not to impair the color tone of the toner, and can stabilize the chargeability of the toner such that the toner is negatively or positively charged. Particularly, metallic salts of salicylic acid derivatives are effective to stabilize the chargeability of the toner such that the toner is negatively charged.

Specific examples of the metallic salts of salicylic acid derivatives include compounds having the following formula (III):

(III)

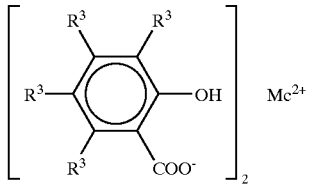

wherein $R^1$, $R^2$, $R^3$ and $R^4$ independently represent a hydrogen atom, an alkyl group having 1 to 10 carbon atoms or an allyl group, preferably a hydrogen atom, an alkyl group having 1 to 6 carbon atoms or an allyl group; and Me represents a metal selected from zinc, nickel, cobalt, chrome, zirconium, etc.

The above-mentioned metallic salts of salicylic acid derivatives can be easily formed by a method mentioned in CLARK, J. L. Kao, H(1948)J. Amer. Chem. Soc. 70, 2151. For example, 2 mols of sodium salt salicylate (including sodium salt of salicylic acid derivative) and 1 mol of zinc chloride are mixed in a solvent, and the mixture is heated and agitated to form a zinc salt.

The metallic salt is a white crystalline and does not color when dispersed in the toner. Other metallic salts besides the zinc salt can be formed in accordance with the above-mentioned method. Specific examples of the preferable metallic salts of the salicylic acid derivatives include compounds having the following formulae (IV).

(IV)

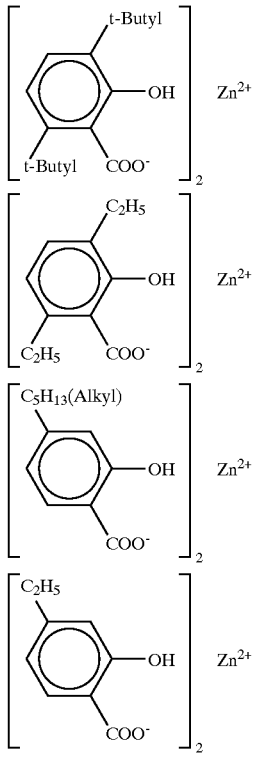

-continued

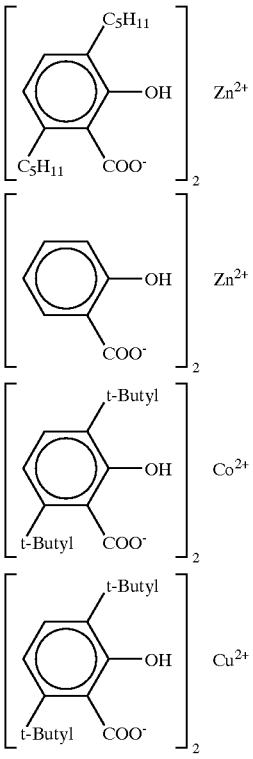

The above-mentioned metallic salts of salicylic acid derivatives have good dispersibility in the binder resin, and are difficult to film over the developing roller, etc.

The content of the metallic salts of salicylic acid derivatives is preferably from 0.5 to 8 parts by weight per 100 parts by weight of the binder resin.

The toner of the present invention can be used as a magnetic toner when a magnetic material is included therein. Specific examples of the magnetic materials include iron oxides such as magnetite, hematite, and ferrite; metals such as cobalt and nickel; or their metal alloys and mixtures with aluminium, copper, lead, magnesium, tin, zinc, stibium, beryllium, bismuth, cadmium, calcium, manganese, selenium, titanium, tungsten, vanadium, etc.

The average particle diameter of the magnetic material is preferably from about 1 to 2 $\mu$m. The content of the magnetic material is from 20 to 200 parts by weight, and preferably from 40 to 150 parts by weight per 100 parts by weight of the binder resin.

A method for manufacturing the color toner of the present invention is (1)–(7) as follows:

(1) a binder resin, a colorant such as a dry pigment, and water are mixed in a mixer such as a Henshel Mixer;

(2) the mixture is kneaded upon application of heat by a method in which an ordinary two-roll mill, a three-roll mill, as well as a Bumbury's mixer, are used as an open-type kneader, or by an open-type continuous two-roll mill kneader manufactured by Mitsui mining Co., Ltd. to prepare a master batch pigment;

(3) a binder resin, a release agent that is insoluble to the binder resin, or other materials such as a controlling agent, are optionally included in the master batch pigment and the mixture is mixed with a mixer such as a Henshel Mixer;

(4) the mixture is further kneaded upon application of heat by a kneader such as a batch type two-roll kneader, a Bumbury's mixer, a continuous biaxial extruder such as KTK biaxial extruder manufactured by Kobe Steel, Ltd., TEM biaxial extruder manufactured by Toshiba Machine Co., Ltd., TEX biaxial extruder manufactured by Japan Steel Works, Ltd., biaxial extruder manufactured by KCK Co., Ltd., PCM biaxial extruder manufacture by Ikegai Corp. and KEX biaxial extruder manufactured by Kurimoto, Ltd., and a continuous one-axis kneader such as KO-KNEADER manufactured by Buss AG;

(5) the thus kneaded mixture is crushed by a hammer mill, etc. and pulverized by a pulverizer such as jet stream pulverizers and mechanical pulverizers;

(6) the pulverized mixture is classified by a classifier such as classifiers using rotary steam and Coanda effect to prepare a mother toner; and then (7) the mother toner and an additive such as titania are mixed with a mixer such as Henshel Mixer manufactured by Mitsui Miike Machinery Co., Ltd., Mechano Fusion System manufactured by Hosokawa Micron Corp. and Mechano Mill manufactured by Okada Seiko Co., Ltd., and optionally sieved with a screen having openings not greater than about 100 $\mu$m to remove the agglomerated and large particles.

When the mother toner and the additives such as titania are mixed, it is preferable that the end peripheral velocity of the mixing blade is from 15 to 35 m/sec and the mixing time is not less than 50 sec.

When the end peripheral velocity of the mixing blade is lower than 15 m/sec or the mixing time of the mother toner and the additive is shorter than 50 sec, the additive may not be uniformly mixed with the mother toner and the free additive adheres to the image bearers such as the photoreceptor, developing roller, and carrier, resulting in occurrence of the toner filming. In addition, the toner is not sufficiently charged to cause the background fouling, toner scattering, and deterioration of the developability of the toner.

When the end peripheral velocity of the mixing blade is higher than 35 m/sec, the additive may strongly adhere to the mother toner and be easily buried in the surface thereof, resulting in occurrence of agglomeration of the toner and insufficient fluidity thereof. In addition, it is probable that the toner is melted by the generated heat in mixing. Particularly the color toner in which the binder resin having many low-molecular-weight components and a low softening point is typically used is more easily melted in mixing.

Particularly in an image forming apparatus and method in which the toner collected from the image bearers such as the photoreceptor, intermediate transfer medium, and transfer belt is recycled for development, the fluidity-deterioration of the toner decreases the transferability thereof to the developing portion. In addition, when transferred to the cleaning and developing portion, the toner receives mechanical forces such as friction and agitation and the toner further tends to be agglomerated. Therefore, when the recycled toner is mixed in the developing portion, the image-transfer irregularity, white spots, background fouling, and contamination in the apparatus by the toner become worse. Further, the heat resistance and developability of the toner deteriorate.

The color toner of the present invention can be used for both one-component developer and two-component developer. As for the two-component-developer, the toner is used together with a carrier.

Known materials can be used for the carrier. Specific examples of the carrier include magnetic powders such as iron powder, ferrite powder, and nickel powder, and glass beads, etc. The surface of the carrier is preferably coated with a resin. Specific examples of the resin include polyfluorocarbon, polyvinylchloride, polyvinylidenechloride, phenol resins, polyvinylacetal, acrylic resins, silicone resins, etc. The coated layer of the resin can be formed by known methods such as spray coating methods and dipping methods.

The content of the resin is from 1 to 10 parts by weight per 100 parts by weight of the carrier. The thickness of the coated layer of the resin is from 0.02 to 2 $\mu$m, preferably from 0.05 to 1 $\mu$m, and more preferably from 0.1 to 0.6 $\mu$m. When the thickness is too thick, the fluidity of the carrier and the developer decrease, and when the thickness is too thin, the coated layer is easily worn out.

The average particle diameter of the carrier is from 10 to 100 $\mu$m, and preferably from 30 to 60 $\mu$m. The typical mixing ratio of the toner to the carrier is that the toner has from 0.5 to 7.0 parts by weight per 100 parts by weight of the carrier.

The color toner and the developer of the present invention are filled in a container when they are used in an image forming apparatus, and it is typical that particularly the container filled with the toner is separately distributed and equipped with the apparatus by the user for forming an image. The above-mentioned container is not limited and any containers can be used besides the conventional bottle or cartridge type containers, or gazette pack for the developer.

The inventors found that when the color toner of the present invention is filled in a container such as a toner cartridge, the adherence of the toner to the internal surface of the container is less than that of the conventional toner, and that the toner has good dischargeability and discharging stability. Further, the inventors found that when the container such as the toner cartridge collected from the market is recycled, the container is easily cleaned and handled.

In addition, it is also found that when the two-component developer including the toner of the present invention and the carrier is filled in a container such as the gazette pack, the adherence of the toner to the internal surface of the container is less than that of the conventional developer, and that the toner scattering scarcely occurs. Therefore, the container is easily handled by the user and the service man, and easily disposed separately.

The image forming apparatus is not limited if it is an apparatus forming an image by an electrophotographic method such as copiers, printers, and facsimiles.

Next, the image forming apparatus of the present invention will be explained.

FIG. 1 is a schematic view illustrating an embodiment of the image forming apparatus of the present invention. The apparatus is formed of an image forming apparatus unit 100 (printer portion), paper feeding table 200 (paper feeding portion), scanner 300 installed on the apparatus 100 (scanner portion), and an automatic original transferer (ADF) 400 on the scanner portion (original transfer portion). In addition, a control portion (not shown) controlling performance of each device in the apparatus is also equipped with the apparatus.

The scanner portion 300 reads the image information of an original put on a contact glass 32 with a reading sensor 36 and transfers the information to the control portion. The control portion controls the laser and light emitting diode (not shown) arranged in an irradiator 21 in the printer portion 100 and irradiates an imagewise light to photoreceptors 40Bk, 40Y, 40M, and 40C based on the information transferred from the scanner portion 300. A latent image is formed on each photoreceptor 40Bk, 40Y, 40M, and 40C by the irradiation and the latent image is developed to a toner image through a predetermined developing process.

The printer portion 100 has a first transferer 62, a second transfer 22, a fixer 25, a deliverer 56, and a toner supplier (not shown), etc. besides the irradiator 21. The above-mentioned developing process will be explained later.

The paper feeding portion 200 has multiple paper feeding cassettes 44 in a paper bank 43, a paper feeding roller 42 feeding a transfer sheet (P), i.e., an image bearer, from the paper feeding cassettes, a separation roller 45 separating and transferring the transfer sheet P to the paper feeding route 46, a transfer roller 47 transferring the transfer sheet P to a paper feeding route 48 in the printer portion 1 00, etc. In the embodiment of the image forming apparatus of the present invention, a paper can be manually fed in addition to be fed from the paper feeding portion, and the apparatus also has a manual feeding tray 51 and a separation roller 52 separating and transferring the transfer sheet P on the manual feeding tray to a paper feeding route 53 on the side. A registration roller 49 discharges only one sheet of the transfer sheet P put on the paper feeding cassettes or manual feeding tray 51, and transfers the sheet to a second transfer nip portion between an intermediate transfer belt 10 as an intermediate transfer medium and the second transferer 22.

When a color image is produced in the image forming apparatus, an original is set on an original table 30 or on the contact glass 32 of the scanner portion 300 by opening the original transfer portion 400, and the original is pressed by closing the original transfer portion 400. When a starting switch (not shown) is turned on, the scanner portion activates after the original is transferred onto the contact glass 32 when the original is set in the original transfer portion 400 or immediately when the original is set on the contact glass 32, and drives a first traveler 33 and a second traveler 34. The first traveler 33 emits light from the light source and reflects the reflected light from the original toward the second traveler 34. The second traveler 34 reflects the light with a mirror to the reading sensor 36 through an image forming lens for the scanner portion 300 to read the image information.

When the image forming apparatus receives the image information from the scanner portion 300, the laser writing as mentioned above and an after-mentioned developing process are performed to form a toner image on each photoreceptor 40Bk, 40Y, 40M, and 40C, and one of the four registration rollers drives to feed the transfer sheet P in proportion to the size of the image information.

Subsequently, a drive motor (not shown) rotates one of support rollers 14, 15, and 16, and the other two rollers are rotated in accordance with the roller driven by the motor to drive the intermediate transfer belt 10. At the same time, an individual image forming unit 18 rotates the photoreceptor drums 40Bk, 40Y, 40M, and 40C and forms a single color image of black, yellow, magenta, and cyan on each photoreceptor, and the single color images are transferred in order onto the intermediate transfer belt 10 to form a composite color image thereon.

On the other hand, one of the paper feeding rollers 42 in the paper feeding portion 200 is selectively rotated to pick up the transfer sheets P from one of the paper feeding cassettes 44, and the separation roller 45 separates the transfer sheets one by one and transfers the transfer sheet to the paper feeding route 46. The transfer roller 47 leads the transfer sheet to the paper feeding route 48 in the image forming apparatus unit 100 and the transfer sheet is stopped against the registration roller 49. Alternatively, a paper feeding roller 50 is rotated to pick up the transfer sheets P on the manual feeding tray 51. The separation roller 52 separates the transfer sheets one by one and transfers the transfer sheet to the paper feeding route 53, and the transfer sheet is stopped against the same registration roller 49.

Then, the registration roller 49 is timely rotated when the composite color image is formed on the intermediate transfer belt 10 to transfer the transfer sheet P to the second transfer nip portion, which is a contact point of the intermediate transfer belt 10 and a second transfer roller 23, and the color image is secondly transferred onto the transfer sheet P by the electric field formed in the nip and the pressure between the intermediate transfer belt and the second transfer roller.

The transfer sheet P after the image transfer is transferred to the fixer 25 by a transfer belt 24 of the second transferee. After the toner image is fixed on the transfer sheet by the pressure of the pressure roller 27 and heat in the fixer 25, the transfer sheet is delivered to a delivery tray 57 by a delivery roller 56.

Figure 2:
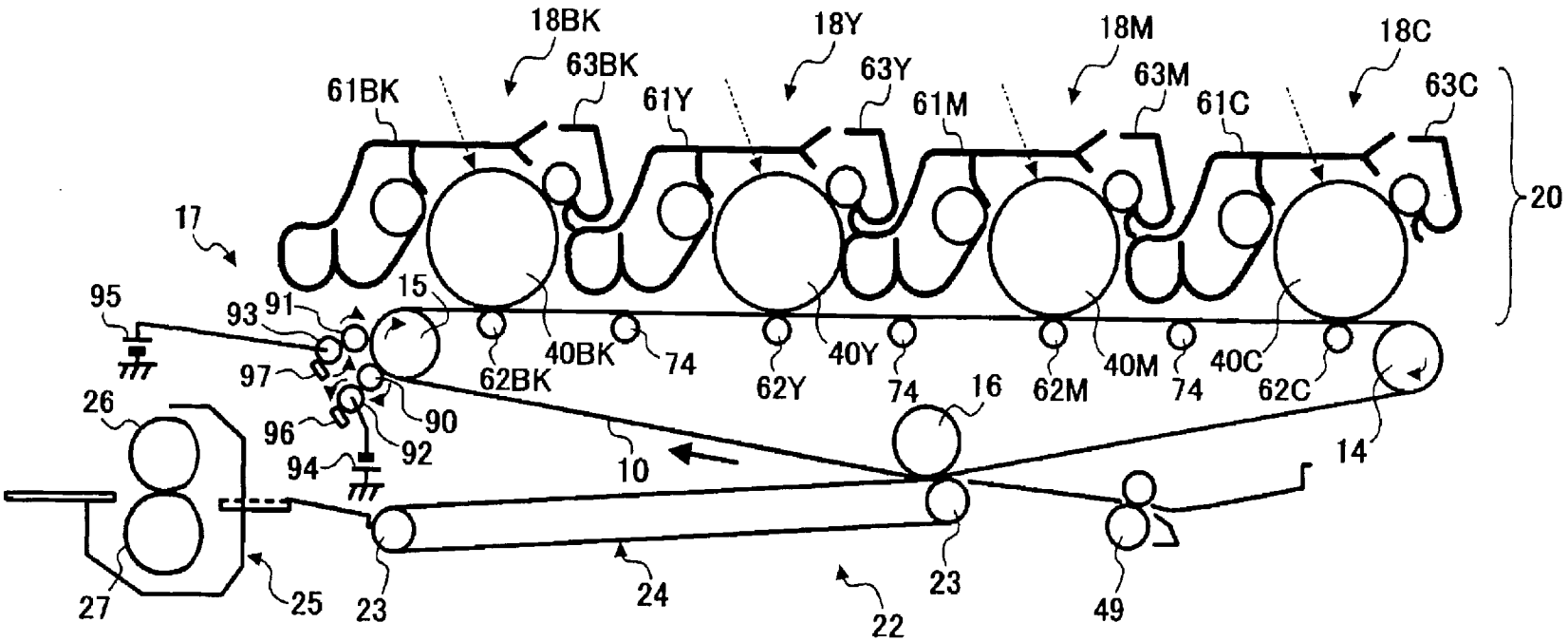
FIG. 2 is a schematic enlarged view illustrating the main part of an embodiment of the printer portion of the present invention.

Next, the details of the printer portion 100 will be explained. FIG. 2 is a schematic enlarged view illustrating the main part of the printer portion 100. The printer portion 100 has the intermediate transfer belt 10 as an intermediate transfer medium supported by the three support rollers 14, 15, and 16. Four photoreceptor drums 40Bk, 40Y, 40M, and 40C are arranged to face the intermediate transfer belt as latent-image bearers bearing one of color toner images of black, yellow, magenta, and cyan, respectively, and developing units 61Bk, 61Y, 61M, and 61C are provided to form toner images on the surface of the photoreceptor drums. Further the printer portion 100 includes photoreceptor cleaners 63Bk, 63Y, 63M, and 63C as well to remove the residual toner from the surface of the photoreceptor drums after the first transfer. A tandem-type image forming device 20 is formed of the plural photoreceptor drums 40Bk, 40Y, 40M, and 40C, the developing units 61Bk, 61Y, 61M, and 61C, and the photoreceptor cleaners 63Bk, 63Y, 63M, and 63C.

On the left of the support roller 15 in FIG. 2, a belt cleaner 17 is arranged to remove the residual toner from the intermediate transfer belt after the toner image is transferred onto the transfer sheet. The belt cleaner 17 has two fur brushes 90 and 91 as cleaning members arranged to contact the intermediate transfer belt 10 and rotate in the reverse direction of the rotating direction thereof. The specifications of the fur brushes 90, 91 are, for example, as follows:

Diameter: 20 mm;

Material: Acrylic carbon;

Fur Girth: 6.25 D/F;

Fur Quantity: 100,000 inch$^2$;

Electric resistance: $1\times10^7$ Ω.

A different polar bias is applied to the fur brushes 90 and 91 respectively from an electric source (not shown). Metallic rollers 92 and 93 are arranged to contact the fur brushes and are rotatable in the forward or reverse direction of the fur brushes.

Negative electricity is applied from an electric source 94 to the metallic roller 92 upstream of the rotating direction of the intermediate transfer belt 10, and positive electricity is applied from an electric source 95 to the metallic roller 93 downstream thereof. The ends of blades 96 and 97 contact the metallic rollers 92 and 93.

In accordance with the rotation of the intermediate transfer belt 10 in a direction indicated by an arrow, the upstream fur brush 90, for example, which is applied with a negative bias, cleans the surface of the intermediate transfer belt 10. When the metallic roller 92 is applied with −700 V, the fur brush 90 has −400 V and a positive toner on the intermediate transfer belt 10 can be transferred to the fur blush 90. The toner transferred to the fur brush is further transferred to the metallic roller 92 due to the difference of the potential, and is scraped off by the blade 96.

Thus, the fur brush 90 removes the toner from the intermediate transfer belt 10; however, a significant quantity of the toner still remains on the intermediate transfer belt 10 even after the operation of the fur brush 90. The toner is negatively charged by the negative bias applied to the fur brush 90. This is considered that the toner is charged by being charged or discharging. Next, the downstream fur brush 91, which is applied with a positive bias, removes the toner. The removed toner is transferred to the metallic roller 93 from the fur brush 91 due the difference of the potential, and is scraped off by the blade 97. The toner scraped off by the blades 96 and 97 is collected in a tank (not shown). The toner may be returned to the image developer 61 using a toner recycler mentioned later.

Although almost all the toner is removed from the surface of the intermediate transfer belt 10 after it is cleaned by the fur brush 91, a little toner still remains on the intermediate transfer belt 10 even after the operation of the fur brush 91.

The residual toner on the intermediate transfer belt 10 is positively charged by the positive bias applied to the fur blush 91 as mentioned above. The positively charged toner is transferred to the photoreceptor drums 40Bk, 40Y, 40M, and 40C by the transfer electric field applied to the toner at the position of the first transfer, and can be collected by the photoreceptor cleaners 63Bk, 63Y, 63M, and 63C.

On the other hand, the second transferer 22 is arranged on the other side of the tandem-type image forming device 20 beyond the intermediate transfer belt 10. The second transferer 22 has the second transfer belt 24 between the two rollers 23 and is arranged to be pressed against a support roller 16 through the intermediate transfer belt 10, and forms the second transfer nip portion to secondly transfer the color toner image on the intermediate transfer belt 10 onto the transfer sheet. The residual toner on the intermediate transfer belt 10 is removed by the cleaner 17 after the second transfer, and the intermediate transfer belt 10 then stands ready for another image formation of the tandem-type image forming apparatus 20.

The second transferer 22 has a transfer function to transfer the transfer sheet P to the fixer 25 after the toner image is transferred. A transfer roller and a nonontact charger may be arranged in the second transferer 22, and in such a case, it is difficult therefor to have the transfer function to transfer the transfer sheet P together.

The registration roller 49 is typically grounded; however, a bias can be applied thereto to remove the paper powder of the transfer sheet P. For example, the bias can be applied using an electroconductive rubber roller. The diameter of the roller can be 18 mm and the surface thereof can be covered by an electroconductive NBR rubber having a thickness of 1 mm. The electric resistance can be about $1\times10^{10}$ Ω·cm, and about −800 V can be applied to a side of the transfer sheet P, onto which the toner is transferred. In addition, +200 V can be applied to the other side of the transfer sheet P.

Generally, since the paper powder is not moved to the photoreceptor in the intermediate transfer method, the paper powder transfer need not be considered and the registration roller 49 may be grounded. In addition, a DC bias can be applied to the registration roller 49; however, an AC voltage having a DC offset property may be used to uniformly charge the transfer sheet P. The surface of the transfer sheet P passed through the registration roller 49 applied with the bias is negatively charged slightly. Therefore, the transfer condition is occasionally changed when the registration roller is applied with the voltage.

In the embodiment of the image forming apparatus in FIG. 1, a transfer sheet reverser 28 is arranged under the second transferer 22 and the fixer 25 in parallel with the tandem-type image forming device 20. The course of the transfer sheet after an image is fixed thereon is changed by a changing pick toward the transfer sheet reverser. Then, the transfer sheet may be reversed with a toner image transferred thereon, and delivered on the delivery tray.

Next, the above-mentioned tandem-type image forming device will be explained.

Figure 3:
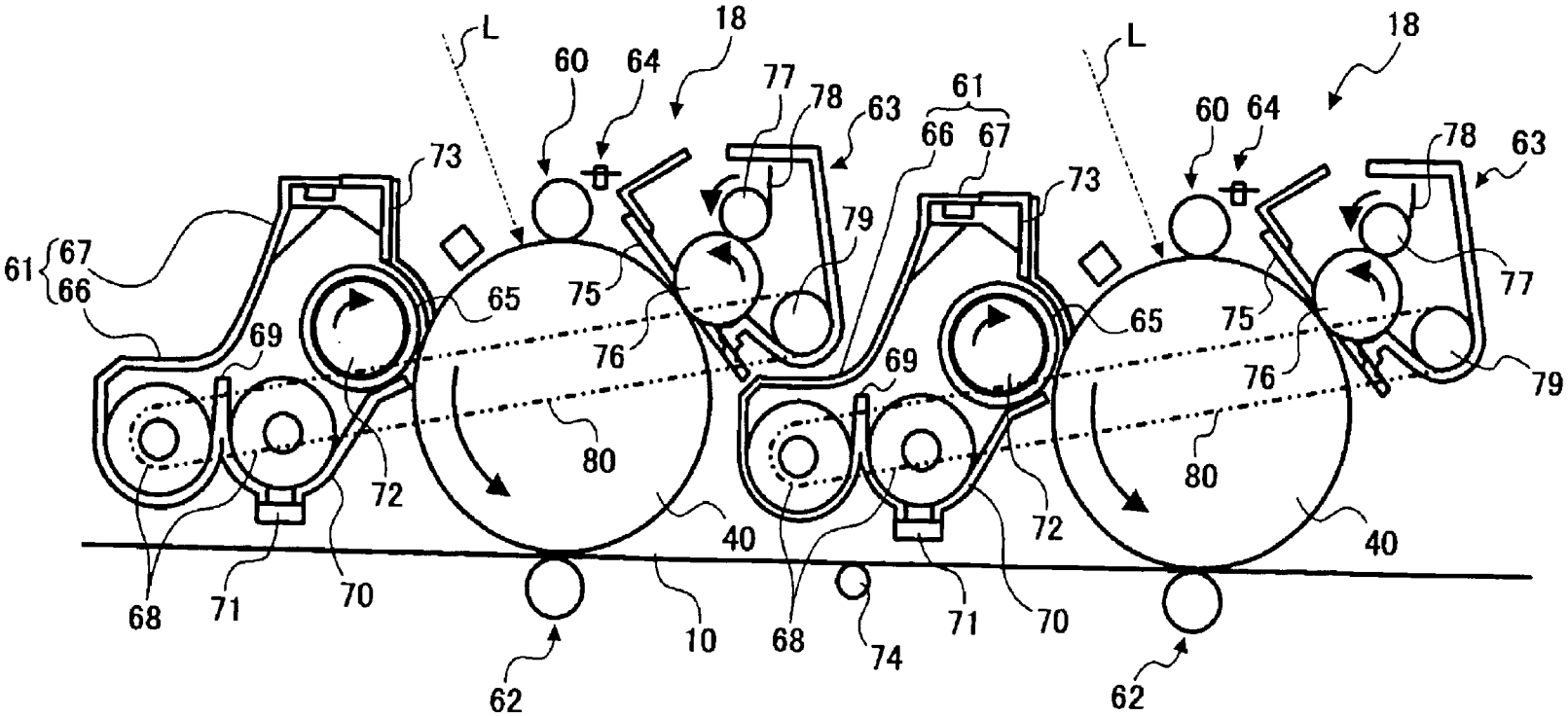
FIG. 3 is a schematic enlarged view illustrating the main part of an embodiment of a tandem-type image forming device of the present invention.

FIG. 3 is a schematic enlarged view illustrating the main part of the tandem-type image forming device 20. Since four image forming units 18Bk, 18Y, 18M, and 18C have the same structures, the color symbols of Bk, Y, M, and C are omitted and the structure of one unit will be explained. As shown in FIG. 3, a charger 60, the image developer 61, the first transferer 62, the photoreceptor cleaners 63, and a discharger 64 are arranged around the photoreceptor drums 40 in the unit.

The above-mentioned photoreceptor drum 40 is drum-shaped and coated with an organic photosensitive material on a tube such as aluminium; however, the photoreceptor may be an endless belt-shaped.

In addition, a process cartridge (not shown) including at least the photoreceptor drum 40 and all or a part of the image forming unit 18 may be formed and detachable with the image forming apparatus 100 for ease of maintenance.

The charger 60 is roller-shaped and charges the photoreceptor drum 40 while contacting the drum. A non-contact scorotron charger can be also used as the charger.

A one-component developer may be used in the image developer 61. However, in FIG. 3, a two-component developer including a magnetic carrier and a non-magnetic toner is used. The image developer 61 has an agitating portion 66 agitating the two-component developer and adhering the developer to a developing sleeve 65, and a developing portion 67 transferring the toner of the two-component developer to the photoreceptor drum 40. The agitating portion is arranged at a lower position than that of the developing portion.

Figure 4:
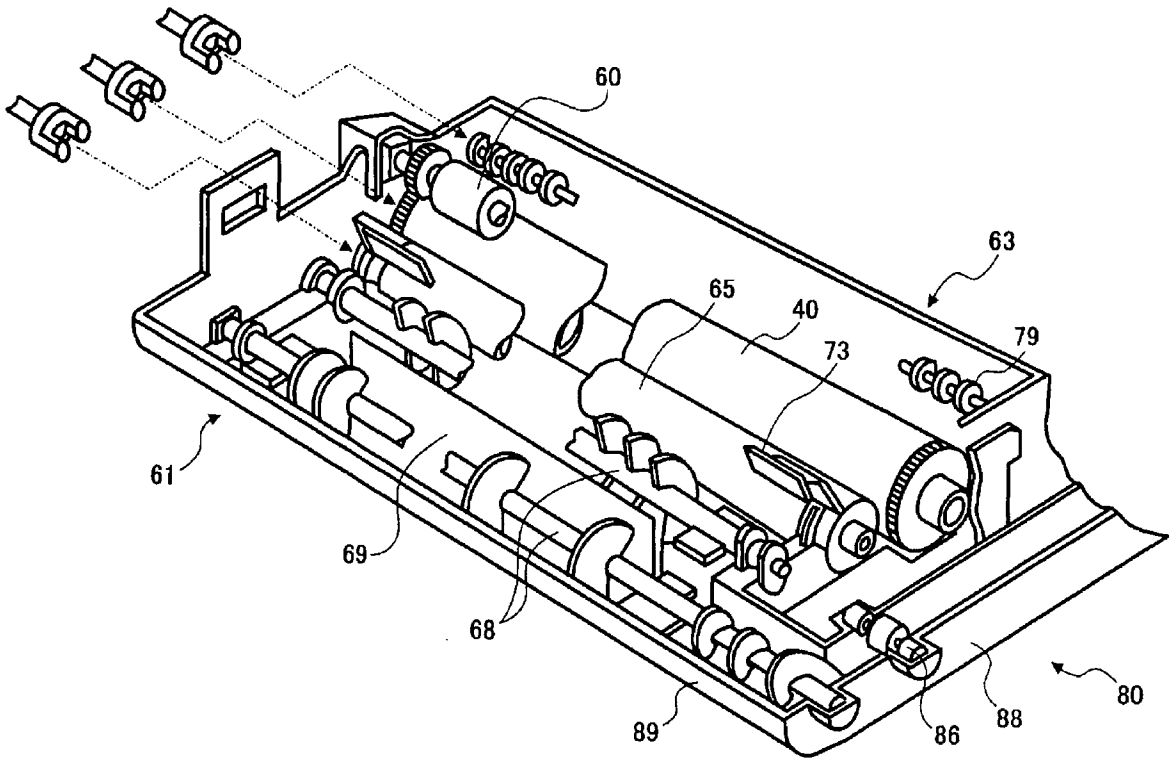
FIG. 4 is an oblique perspective view illustrating an embodiment of a photoreceptor drum and a proximity members of the present invention.

The agitating portion 66 has two parallel screws 68 and a partition plate 69 separates the two screws except for the ends thereof (refer to FIG. 4). In addition, a concentration sensor 71 is formed in a developing case 70.

In the developing portion 67, the developing sleeve 65 is formed to face the photoreceptor drum 40 through the opening of the developing case 70, and a magnet device 72 is fixed in the developing sleeve 65. In addition, a doctor blade 73 is formed with the end which is close to the developing sleeve 65. In FIG. 3, the shortest distance between the doctor blade 73 and the developing sleeve 65 is 500 $\mu$m.

The developing sleeve 65 is non-magnetic and sleeve-shaped, and has plural magnets 72 inside. The fixed magnets can apply the magnetic force to the developer when passing a predetermined position. In FIG. 3, the diameter of the developing sleeve can be 18 mm, and the surface thereof can be abraded with a sand blast or formed to have plural grooves having a depth of from 1 to a few mm such that the ten-point mean roughness (RZ) is within a range of from 10 to 30 $\mu$m.

The magnet 72, for example, has five poles N1, S1, N2, S2, and S3 in the rotating direction of the developing sleeve from the position of the doctor blade.

The developer forms a magnetic brush by the magnet 72 and is borne on the developing sleeve 65. The developing sleeve 65 is arranged in an area on the S1 side of the magnet 72 that formed the magnetic brush of the developer, facing the photoreceptor drum 40.

Thus, the two-component developer is transferred and circulated by the two screws 68 while being agitated thereby, and supplied to the developing sleeve 65. The developer supplied to the developing sleeve 65 is held by the magnet 72 and forms the magnetic brush on the developing sleeve 65. The head of the magnetic brush is properly cut by the doctor blade 73 in accordance with the rotation of the developing sleeve 65. The cut developer is returned to the agitating portion 66. The toner of the developer borne on the developing sleeve 65 is transferred onto the photoreceptor drum 40 by the developing bias voltage applied to the developing sleeve 65, and visualizes the latent image on the photoreceptor drum 40. After the visualization, the residual developer on the developing sleeve 65 is released therefrom at a position where the magnetic force of the magnet 72 does not work, and is returned to the agitating portion 66. When the concentration of the toner in the agitating portion 66 becomes lower as the above process is repeated, the toner concentration sensor 71 detects the low concentration of the toner and the toner is supplied to the agitating portion 66.

In FIG. 3, the linear speeds of the photoreceptor drum 40 and the developing sleeve 65 can be 200 mm/sec and 240 mm/sec respectively, and the diameters can be 50 mm and 18 mm respectively. The charge quantity of the toner on the developing sleeve 65 is preferably from −10 to −30 $\mu$C/g. The developing gap between the photoreceptor drum 40 and the developing sleeve 65 (GP) can be conventionally adjusted from 0.4 to 0.8 mm. The smaller the gap, the more improved the developing efficiency.

Further, the thickness of the photoreceptor can be 30 $\mu$m, the beam spot diameter can be 50×60 $\mu$m, and the amount of light can be 0.47 mW. In addition, the potential of the photoreceptor drum 40 before irradiation V0 can be −700 V, potential after irradiation can be −120 V, and the developing bias voltage can be −470 V, i.e., the developing potential can be 350 V to perform the developing process.

The first transferer 62 is a roller-shaped first transfer roller 62 and is pressed against the photoreceptor drum 40 through the intermediate transfer belt 10. Between each first transfer roller, a conductive roller 72 is formed to contact the base layer of the intermediate transfer belt 10. The conductive roller 72 prevents the bias applied by each first transfer roller 62 from flowing into each image forming unit 18 located thereto through the base layer having a middle resistance.

The photoreceptor cleaner 63 has a cleaning blade made of, for example, a polyurethane rubber, and the end of the blade is pressed against the photoreceptor drum 40. Further, in FIG. 3, the conductive fur brush 76 is rotatable in the direction indicated by an arrow and its periphery contacts the photoreceptor drum 40. In addition, a metallic electric field roller 77 rotatable in the direction indicated by an arrow, which applies a bias to the fur brush 76, is provided, and the end of a scraper 67 is pressed against the electric field roller 77. Further, a collection screw 79 collecting the removed toner is also provided.

In the above-mentioned photoreceptor cleaner 63, the fur brush 76 rotating in the reverse direction of the photoreceptor drum 40 removes the residual toner thereon. The toner adhered to the fur brush 76 is removed by the electric field roller 77 rotating in the reverse direction of the fur brush 76 in contact therewith, and which is applied with a bias. The toner adhered to the electric field roller 77 is removed by the scraper 78. The toner collected in the photoreceptor cleaner 63 is collected together on one side thereof by the collection screw 79 and returned to the image developer 61 by an after-mentioned toner recycler 80 to be recycled.

A discharging lamp is used as the discharger 64 and initializes the surface potential of the photoreceptor drum 40.

The above developing process will be explained. In accordance with the rotation of the photoreceptor drum 40, the surface thereof is first uniformly charged by the charger 60. Imagewise light is irradiated on the photoreceptor drum 40 to form a latent image thereon. The image developer 61 causes the toner to adhere to the latent image to form a toner image, and the toner image is firstly transferred onto the intermediate transfer belt 10 by the first transfer roller 62. The residual toner on the surface of the photoreceptor drum 40 after the image transfer is removed by the photoreceptor cleaner 63, and the discharger 64 discharges the photoreceptor drum 40 to stand ready for another image formation. On the other hand, the residual toner removed from the surface of the photoreceptor drum is reused for development by the after-mentioned toner recycler. The order of forming colors of an image is not limited thereto, and can be different according to the object and property of the image forming apparatus.

Next, the toner recycling process will be explained, referring to FIGS. 4 and 5. FIG. 4 is an oblique perspective view illustrating the photoreceptor drum 40 and the proximity members, and FIG. 5 is an oblique perspective view illustrating the collection screw in the photoreceptor cleaner 63.

Figure 5:
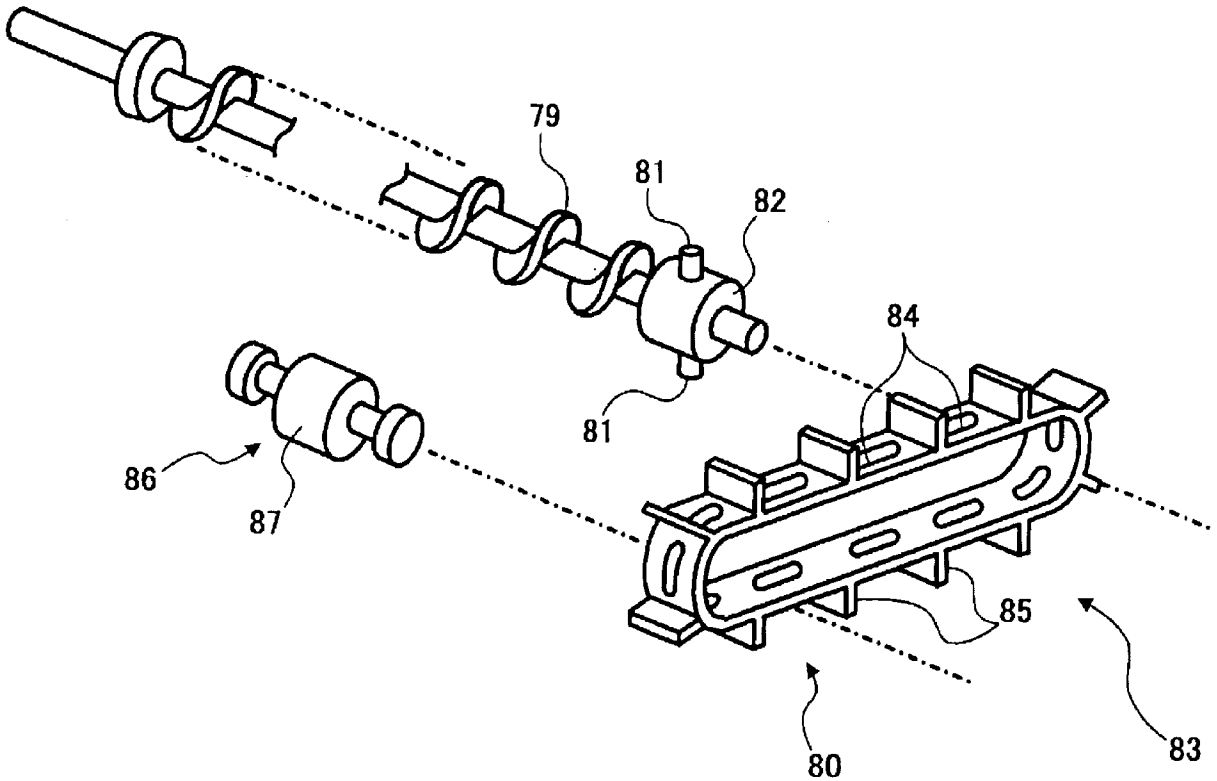
FIG. 5 is an oblique perspective view illustrating an embodiment of a collection screw in a photoreceptor cleaner of the present invention.

As shown in FIG. 5, the collection screw 79 in the photoreceptor cleaner 63 has a roller portion 82 having a pin 81. One side of a collected-toner transfer member 83 that is belt-shaped is hung on the roller portion 82, and the pin 81 is inserted in a long hole 84 of the collected-toner transfer member 83. The periphery of the collected-toner transfer member 83 has blades 85 at a fixed interval, and the other side of the collected-toner transfer member 83 is hung on a roller portion 87 of a rotating axis 86. The collected-toner transfer member 83 is put in a transfer route case 88 shown in FIG. 4 together with the rotating axis 86.

The transfer route case 88 is formed together with a cartridge case 89 in a body, and the end of one of the two screws 68 in the image developer 61 is inserted into the transfer route case 88. An outside driving force rotates the collection screw 79 and the collected-toner transfer member 83, and the toner collected by the photoreceptor cleaner 63 is transferred to the image developer 61 through the transfer route case 88 and put in the image developer 61 by the rotation of the screw 68. Then, as mentioned above, the collected toner is agitated with the developer in the image developer 61 by the two screws 68 and circulated to be used for development.

Having generally described this invention, further understanding can be obtained by reference to certain specific examples provided herein for the purpose of illustration only and are not intended to be limiting. In the descriptions in the following examples, the numbers represent weight ratios in parts, unless otherwise specified.

EXAMPLES

[Manufacturing Examples of Master Batch Pigment]

Manufacturing Example 1

The following materials were mixed by a Henshel Mixer and kneaded by a two-roll kneader for 45 min, in which the surface temperature of the rolls was 130° C. to prepare a master batch pigment A.

Binder resin: Polyester resin A 50

(a polyester resin formed from adducts of bisphenol A with ethylene oxides, terephthalic acid, and fumaric acid, having a softening point of 95° C.)

Colorant: Quinacridone magenta pigment 50

(C.I. Pigment Red 122)

Water: 30

Manufacturing Example 2

The following materials were mixed by a Henshel Mixer and kneaded by a two-roll kneader for 45 min, in which the surface temperature of the rolls was 130° C. to prepare a master batch pigment B.

Binder resin: Polyol resin A 50

(a polyol resin formed from low molecular weight bisphenol A type epoxy resin, high molecular weight bisphenol A type epoxy resin, bisphenol A type glycidylated adducts with ethylene oxides, bisphenol F, and p-cumylphenol, having a softening point of 97° C.)

Colorant: Quinacridone magenta pigment 50

(C.I. Pigment Red 122)

Water: 30

Manufacturing Example 3

The following materials were mixed by a Henshel Mixer and kneaded by a two-roll kneader for 45 min, in which the surface temperature of the rolls was 130° C. to prepare a master batch pigment C.

Binder resin: Polyol resin A 50

(a polyol resin formed from low molecular weight bisphenol A type epoxy resin, high molecular weight bisphenol A type epoxy resin, bisphenol A type glycidylated adducts with ethylene oxides, bisphenol F, and p-cumylphenol, having a softening point of 97° C.)

Colorant: Copper phthalocyanine pigment 50

(C.I. Pigment Blue 15:3)

Water: 30

Manufacturing Example 4

The following materials were mixed by a Henshel Mixer and kneaded by a two-roll kneader for 45 min, in which the surface temperature of the rolls was 130° C. to prepare a master batch pigment D.

Binder resin: Polyol resin A 50

(a polyol resin formed from low molecular weight bisphenol A type epoxy resin, high molecular weight bisphenol A type epoxy resin, bisphenol A type glycidylated adducts with ethylene oxides, bisphenol F, and p-cumylphenol, having a softening point of 97° C.)

Colorant: Disazo yellow pigment 50

(C.I. Pigment Yellow 17)

Water: 30

Manufacturing Example 5

The following materials were mixed by a Henshel Mixer and kneaded by a two-roll kneader for 45 min, in which the surface temperature of the rolls was 130° C. to prepare a master batch pigment E.

Binder resin: Polyester resin B 50

(a polyester resin formed from adducts of bisphenol A with ethylene oxides and propylene oxides, terephthalic acid, succinic acid derivatives, and trimellitic anhydride, having a softening point of 121° C.)

Colorant: Quinacridone magenta pigment 50

(C.I. Pigment Red 122)

Water: 30

Manufacturing Example 6

The following materials were mixed by a Henshel Mixer and kneaded upon application of heat by a biaxial kneader in which the temperature was set at 140° C. to prepare a master batch pigment F.

Binder resin: Polyol resin A 50

(a polyol resin formed from low molecular weight bisphenol A type epoxy resin, high molecular weight bisphenol A type epoxy resin, bisphenol A type glycidylated adducts with ethylene oxides, bisphenol F, and p-cumylphenol, having a softening point of 97° C.)

Colorant: Quinacridone magenta pigment 50

(C.I. Pigment Red 122)

Organic solvent: Acetone 20

Example 1

The following materials were mixed with a Henshel mixer and kneaded upon application of heat by a biaxial kneader in which the temperature was set at 110° C. The mixture was cooled by water and crushed by a cutter mill, and pulverized by a pulverizer using a jet stream to prepare a mother toner using a wind classifier.

Binder resin: Polyester resin A 93

(a polyester resin formed from adducts of bisphenol A with ethylene oxides, terephthalic acid, and fumaric acid, having a softening point of 95° C.)

Colorant: Master batch pigment A 14

Release agent: Carnauba wax 5

(melting point: 92° C. and Mw/Mn: 1.1)

Charge controlling agent: Zinc salts of 2.5 salicylic acid derivatives

Further, the following materials were mixed by a Henshel Mixer for 300 sec, in which the end peripheral velocity of the mixing blade was set at 20 m/sec, and then the mixture was wind sieved with a sieve having an opening of 100 μm to prepare the toner of the present example.

The above-mentioned mother toner 100

Additives: Titania 0.8

(surface-treated with isobutyltrimethoxy silane having an average primary particle diameter of 0.02 μm)

Silica 0.6

(surface-treated with hexamethyldisilazane having an average primary particle diameter of 0.016 μm)

Example 2

The procedure for preparation of the toner of Example 1 was repeated except that the binder resin was changed to the polyol resin A (used in Manufacturing Example 2) and the colorant was changed to the master batch pigment B (Manufacturing Example 2) to prepare a toner.

Example 3

The procedure for preparation of the toner of Example 2 was repeated except that the quantity of the polyol resin as the binder resin was changed to 96.4 parts by weight and the colorant was changed to 7.2 parts by weight of the master batch pigment C (Manufacturing Example 3) to prepare a toner.

Example 4

The procedure for preparation of the toner of Example 2 was repeated except that the colorant was changed to the master batch pigment D (Manufacturing Example 4) to prepare a toner.

Example 5

The procedure for preparation of the toner of Example 2 was repeated except that the pulverizing condition of the mother toner was changed to prepare a toner.

Example 6

The procedure for preparation of the toner of Example 2 was repeated except that the release agent was changed to a polyethylene wax (having a melting point of 88° C. and Mw/Mn is 1.1) to prepare a toner.

Example 7

The procedure for preparation of the toner of Example 2 was repeated except that the release agent was changed to a carnauba wax subjected to a treatment of eliminating free fatty acid therefrom (having a melting point of 90° C. and Mw/Mn is 1.1) to prepare a toner.

Example 8

The procedure for preparation of the toner of Example 2 was repeated except that the release agent was changed to a carnauba wax subjected to a treatment of eliminating free fatty acid therefrom (having a melting point of 82° C. and Mw/Mn is 1.1) to prepare a toner.

Example 9

The procedure for preparation of the toner of Example 2 was repeated except that the release agent was changed to a carnauba wax subjected to a treatment of eliminating free fatty acid therefrom (having a melting point of 99° C. and Mw/Mn is 1.2) to prepare a toner.

Example 10

The procedure for preparation of the toner of Example 2 was repeated except that the release agent was changed to a carnauba wax subjected to a treatment of eliminating free fatty acid therefrom (having a melting point of 93° C. and Mw/Mn is 1.5) to prepare a toner.

Example 11

The procedures of preparation for the toner in Example 2 were repeated to prepare a toner except for changing the titania to titania subjected to a surface treatment with isobutyltrimethoxy silane, which has an average primary particle diameter of 0.05 μm.

Example 12

The procedure for preparation of the toner of Example 1 was repeated except that the binder resin was changed to the polyester resin B (used in Manufacturing Example 5) and the colorant was changed to the master batch pigment E (Manufacturing Example 5) to prepare a toner.

Example 13

The procedure for preparation of the toner of Example 2 was repeated except that the binder resin was changed to 43 parts by weight of the polyol resin A and 50 parts by weight of a N styrene-acryl resin A (a styrene/n-butylmethacrylate copolymer having a softening point of 92° C.) to prepare a toner.

Example 14

The procedure for preparation of the toner of Example 2 was repeated except that the zinc salts of salicylic acid derivatives as the controlling agent was removed to prepare a toner.

Comparative Example 1

The procedure for preparation of the toner of Example 2 was repeated except that the colorant was changed to the master batch pigment F (Manufacturing Example 6) to prepare a toner.

Comparative Example 2

The procedure for preparation of the toner of Example 2 was repeated except that the quantity of the polyol resin as the binder resin was changed to 100 parts by weight and the colorant was changed to 7 parts by weight of the quinacridone magenta pigment (C.I. Pigment Red 122) to prepare a toner.

Comparative Example 3

The procedure for preparation of the toner of Comparative Example 2 was repeated except that the colorant was changed to 3.6 parts by weight of the copper phthalocyanine blue pigment (C.I. Pigment Blue 15:3) to prepare a toner.

Comparative Example 4

The procedure for preparation of the toner of Comparative Example 2 was repeated except that the colorant was changed to 7 parts by weight of the disazo yellow pigment (C.I. Pigment Yellow 17) to prepare a toner.

Comparative Example 5

The procedure for preparation of the toner of Example 2 was repeated except that the release agent was changed to a montan wax (having a melting point of 95° C. and Mw/Mn is 1.2) to prepare a toner.

Comparative Example 6

The procedure for preparation of the toner of Example 2 was repeated except that the mixture was kneaded by a two-roll kneader for 90 min. for the purpose of applying a strong shearing force to the mixture, in which the surface temperature of the roll was 100° C. to prepare a toner.

Comparative Example 7

The procedure for preparation of the toner of Example 2 was repeated except that the quantity of the carnauba wax as the release agent was changed to 15 parts by weight to prepare a toner.

Comparative Example 8

The procedure for preparation of the toner of Example 2 was repeated except that the release agent was changed to a polyethylene wax (having a melting point of 70° C. and Mw/Mn is 1.1) to prepare a toner.

Comparative Example 9

The procedure for preparation of the toner of Example 2 was repeated except that the release agent was changed to a polyethylene wax (having a melting point of 113° C. and Mw/Mn is 1.1) to prepare a toner.

Comparative Example 10

The procedure for preparation of the toner of Example 2 was repeated except that the kneading temperature was changed from 100 to 180° C. to prepare a toner.

Comparative Example 11

The procedure for preparation of the toner of Example 2 was repeated except that the quantity of the titania as the additive was changed to 2 parts by weight to prepare a toner.

Comparative Example 12

The procedure for preparation of the toner of Example 2 was repeated except that the mixing time of the additive was changed to 20 sec to prepare a toner.

Comparative Example 13

The procedure for preparation of the toner of Example 2 was repeated except that the end peripheral velocity of the mixing blade was changed to 10 m/sec and the mixing time was changed to 100 sec to prepare a toner.

The weight-average particle diameter($D_4$), number-average particle diameter(Dn), average dispersion particle diameter of the colorant(Dc), average dispersion particle diameter for the release agent(Dw), and segregation rate of the titania (Sr) of the toners of these Examples and Comparative Examples were measured, and $Dw/D_4$ and $D_4/Dn$ were calculated. The results are shown in Table 1.

In addition, a release agent was not observed in the toner of Comparative Example 5 because the release agent was dissolved in the binder resin.

TABLE 1

| | Color | $D_4$ (μm) | Dn (μm) | $D_4$/Dn | Dc (μm) | Dw (μm) | Dw/$D_4$ | Sr (%) |
|---|---|---|---|---|---|---|---|---|
| Ex. 1 | Magenta | 6.80 | 5.53 | 1.23 | 0.44 | 1.44 | 0.21 | 2.8 |
| Ex. 2 | Magenta | 7.21 | 6.00 | 1.20 | 0.41 | 1.04 | 0.14 | 2.7 |
| Ex. 3 | Cyan | 6.87 | 5.63 | 1.22 | 0.37 | 1.49 | 0.22 | 2.7 |
| Ex. 4 | Yellow | 6.36 | 5.25 | 1.21 | 0.31 | 1.60 | 0.25 | 1.6 |
| Ex. 5 | Magenta | 7.43 | 5.49 | 1.35 | 0.40 | 1.84 | 0.25 | 2.8 |
| Ex. 6 | Magenta | 7.50 | 6.20 | 1.21 | 0.43 | 1.19 | 0.16 | 1.9 |
| Ex. 7 | Magenta | 6.34 | 5.27 | 1.20 | 0.35 | 1.34 | 0.21 | 2.7 |
| Ex. 8 | Magenta | 7.44 | 6.17 | 1.21 | 0.39 | 2.16 | 0.29 | 2.7 |
| Ex. 9 | Magenta | 6.38 | 5.11 | 1.25 | 0.44 | 2.10 | 0.33 | 2.0 |
| Ex. 10 | Magenta | 6.37 | 5.29 | 1.20 | 0.38 | 1.69 | 0.27 | 2.4 |
| Ex. 11 | Magenta | 7.09 | 5.77 | 1.23 | 0.41 | 1.61 | 0.23 | 2.3 |
| Ex. 12 | Magenta | 6.98 | 5.71 | 1.22 | 0.38 | 1.54 | 0.22 | 2.1 |
| Ex. 13 | Magenta | 7.36 | 6.02 | 1.22 | 0.45 | 1.01 | 0.14 | 2.5 |
| Ex. 14 | Magenta | 6.98 | 5.69 | 1.23 | 0.37 | 1.91 | 0.27 | 2.6 |
| Comp. Ex. 1 | Magenta | 6.33 | 5.14 | 1.23 | 0.71 | 1.32 | 0.21 | 1.9 |
| Comp. Ex. 2 | Magenta | 6.43 | 5.19 | 1.24 | 1.19 | 1.69 | 0.26 | 2.8 |
| Comp. Ex. 3 | Cyan | 6.91 | 5.66 | 1.22 | 1.00 | 1.61 | 0.23 | 1.9 |
| Comp. Ex. 4 | Yellow | 7.19 | 5.99 | 1.20 | 1.07 | 1.00 | 0.14 | 2.5 |
| Comp. Ex. 5 | Magenta | 6.98 | 5.71 | 1.22 | 0.30 | Not observed | — | 1.7 |
| Comp. Ex. 6 | Magenta | 6.44 | 5.33 | 1.21 | 0.40 | 0.26 | 0.04 | 2.9 |
| Comp. Ex. 7 | Magenta | 6.08 | 4.97 | 1.22 | 0.41 | 2.91 | 0.48 | 1.8 |
| Comp. Ex. 8 | Magenta | 6.22 | 5.13 | 1.21 | 0.34 | 2.71 | 0.44 | 2.0 |
| Comp. Ex. 9 | Magenta | 6.60 | 5.43 | 1.22 | 0.35 | 2.74 | 0.42 | 2.5 |
| Comp. Ex. 10 | Magenta | 6.11 | 4.95 | 1.23 | 0.43 | 2.63 | 0.43 | 1.8 |
| Comp. Ex. 11 | Magenta | 6.88 | 5.61 | 1.23 | 0.41 | 1.73 | 0.25 | 8.5 |
| Comp. Ex. 12 | Magenta | 7.25 | 5.96 | 1.22 | 0.45 | 1.53 | 0.21 | 8.8 |
| Comp. Ex. 13 | Magenta | 7.32 | 5.97 | 1.23 | 0.40 | 1.11 | 0.15 | 9.2 |

[Manufacturing Example of Carrier]

The following materials were dispersed with a homomixer for 30 min to prepare a coating liquid.

Silicone resin 100

(SR-2411 manufactured by Dow Corning Toray Silicone Co., Ltd. having a solid content of 20% by weight)

Toluene 100

The coating liquid was coated on 1000 parts by weight of Cu—Zn ferrite having an average particle diameter of 50 μm by a fluidized bed coater, and the coated ferrite was burned for 2 hrs. at 250° C. to prepare a carrier.

[Manufacturing Example of Developer]

Five (5) parts by weight of each toner of Examples and Comparative Examples and 95 parts by weight of the above-mentioned carrier were mixed with a Turbula mixer to prepare two-component developers having a toner concentration of 5%.

[Evaluation Method]

The toners of the Examples and Comparative Examples and the above-mentioned developers were set in the image forming apparatus in FIG. 1, having the fixer including a fixing roller 26 formed of a silicone roller containing a heater and the pressure roller 27 formed of a teflon tube coated with silicone (not including an oil applicator), and the following Evaluations 1 to 3 and 5 to 10 were performed under an environment of room temperature and humidity.

Further, 50,000 continuous images were produced under an environment of room temperature and humidity, and the following Evaluations 4 to 10 were performed.

The Evaluations of 2 to 10 have the following 5 grades. The results of the evaluations are shown in Table 2, with the following indications ◎: Very good ○: Good □: Normal Δ: can be practically used X: cannot be practically used <Evaluation 1: Fixability>

The evaluation of the fixability was performed by producing a solid image having an adhered toner quantity of 1.00±0.05 mg/cm$^2$ on a transfer sheet Type 6000 <70W> manufactured by Ricoh Company, Ltd. using the image forming apparatus in FIG. 1, and measuring the cold and hot offset occurrence, temperatures, changing the temperature of the fixing roller in increments of 5° C. under the following fixing conditions:

The linear speed of the fixer: 180±2 mm/sec

The width of the fixing nip: 10±1 mm

<Evaluation 2: Transparency>

The evaluation of the transparency was performed by producing a solid image having an adhered toner quantity of 1.00±0.05 mg/cm$^2$ on an OHP sheet Type PPC-DX manufactured by Ricoh Elemex Corp. under the following fixing conditions, and measuring the haze factors of each color solid image by a direct haze computer HGM-2DP manufactured by Suga Test Instruments Co., Ltd. The haze factors were graded into five grades according to the following standard.

The linear speed of the fixer: 90±2 mm/sec

The width of the fixing nip: 10±1 mm

The fixing roller temperature: 160±2° C.

◎: less than 20%

○: 20 to 25%

□: 25 to 30%

Δ: 30 to 35% x: not less than 35%

The haze factor is used as a gauge to measure the transparency of the toner. The lower the value, the higher the transparency and the better color reproducibility when using an OHP.

<Evaluation 3: Color Reproducibility>

The evaluation of the color reproducibility was performed by measuring the color saturation (C) of each color solid image in Evaluation 1 by X-Rite938 when the surface temperature of the fixing roller was 160±2° C. The color reproducibility was graded into five grades according to the following standard. The higher the color saturation, the better color reproducibility.

| | Magenta | Cyan | Yellow |
|---|---|---|---|
| ◎ | 76 or more | 64 or more | 104 or more |
| ○ | 72 to 75 | 60 to 63 | 100 to 103 |
| □ | 68 to 71 | 56 to 59 | 96 to 99 |
| Δ | 64 to 67 | 52 to 55 | 92 to 95 |
| x | less than 64 | less than 52 | less than 92 |

<Evaluation 4: Fluidity>

The evaluation of the fluidity was performed by measuring the fluidity of the developer after the continuous 50,000 images were produced. Specifically, the 50.0 g of the developer was put into the entrance of a bulk specific gravity meter having an orifice diameter of 3.00 while the exit was closed. The time from opening the exit until the developer was completely discharged was measured by a stopwatch, and the time was graded into five grades according to the following standard. When measured, the concentration of the toner in the developer was kept at 5%. The shorter the time, the better the fluidity.

◎: less than 35 sec

○: 35 to 39 sec

□: 40 to 45 sec

Δ: 46 to 49 sec x: not less than 50 sec

<Evaluation 5: Background Fouling>

The evaluation of the background fouling was performed by measuring the image density with X-Rite938 of an adhesive tape on which the residual toner on a non-image portion of the photoreceptor was transferred at the beginning of and after the 50,000 continuous images were produced. Then, the difference of the image density between that of tapes on which the toner was transferred and that of the original tape was compared. The larger the difference, the worse the background fouling.

<Evaluation 6: Toner Scattering>

The evaluation of the toner scattering was performed by visually evaluating the toner scattering in the image forming apparatus at the beginning of and after the 50,000 continuous images were produced.

<Evaluation 7: Filming>

The evaluation of the filming was performed by visually evaluating the filming on the photoreceptor and the intermediate transfer medium, etc. after the 50,000 continuous images were produced.

<Evaluation 8: Hollow Defects>

The evaluation of the hollow defects was performed by visually evaluating the hollow defects with a microscope VH-5910 manufactured by Keyence Corp of a thin line having one dot produced at the beginning of and after the 50,000 continuous images were produced.

<Evaluation 9: Transfer Irregularity and White Spots>

The evaluation of the transfer irregularity and white spots was performed by visually evaluating 10 continuous sheets of an A3 size solid image produced at the beginning of and after the 50,000 continuous images were produced.

<Evaluation 10: Durability>

The evaluation of the durability was performed by measuring the image density with X-Rite938 of a solid image produced at the beginning of and after the 50,000 continuous images were produced to compare the difference of the image density. The lower the image density after the 50,000 continuous images were produced, the worse the durability.

In addition, the Evaluations 2 to 10 could not be performed for the toner of Comparative Example 5 because the range of the fixing temperature could not be determined.

TABLE 2

| | Color | Evaluation 1 Cold Offset Occurrence Temperature | Evaluation 1 Hot Offset Occurrence Temperature | Evaluation 2 Transparency | Evaluation 3 Color Reproducibility |
|---|---|---|---|---|---|
| Example 1 | Magenta | 120 | 190 | ◎ | ◎ |
| Example 2 | Magenta | 120 | 190 | ◎ | ◎ |
| Example 3 | Cyan | 120 | 190 | ◎ | ◎ |
| Example 4 | Yellow | 120 | 190 | ◎ | ◎ |
| Example 5 | Magenta | 130 | 180 | ○ | ○ |
| Example 6 | Magenta | 120 | 195 | ◎ | ◎ |
| Example 7 | Magenta | 120 | 200 | ◎ | ◎ |
| Example 8 | Magenta | 120 | 180 | □ | □ |
| Example 9 | Magenta | 130 | 200 | □ | ○ |
| Example 10 | Magenta | 120 | 185 | ◎ | ◎ |
| Example 11 | Magenta | 130 | 180 | □ | ○ |
| Example 12 | Magenta | 130 | 200 | □ | □ |
| Example 13 | Magenta | 125 | 185 | □ | □ |
| Example 14 | Magenta | 120 | 190 | ◎ | ◎ |
| Comparative Ex. 1 | Magenta | 120 | 190 | Δ | Δ |
| Comparative Ex. 2 | Magenta | 120 | 190 | x | x |
| Comparative Ex. 3 | Cyan | 120 | 190 | x | x |
| Comparative Ex. 4 | Yellow | 120 | 190 | x | x |
| Comparative Ex. 5 | Magenta | No range of Fixing temperature | | Not available | Not available |
| Comparative Ex. 6 | Magenta | 140 | 165 | ◎ | ◎ |
| Comparative Ex. 7 | Magenta | 120 | 190 | x | x |
| Comparative Ex. 8 | Magenta | 120 | 170 | Δ | Δ |
| Comparative Ex. 9 | Magenta | 140 | 200 | Δ | □ |
| Comparative Ex. 10 | Magenta | 120 | 195 | Δ | Δ |
| Comparative Ex. 11 | Magenta | 130 | 175 | x | Δ |
| Comparative Ex. 12 | Magenta | 120 | 190 | Δ | ○ |
| Comparative Ex. 13 | Magenta | 120 | 190 | Δ | ○ |

| | Color | Evaluation 4 Fluidity | Evaluation 5 Background Fouling Beginning | Evaluation 5 Background Fouling After 50,000 images were produced | Evaluation 6 Toner Scattering Beginning | Evaluation 6 Toner Scattering After 50,000 images were produced |
|---|---|---|---|---|---|---|
| Example 1 | Magenta | ◎ | ◎ | ◎ | ◎ | ◎ |
| Example 2 | Magenta | ◎ | ◎ | ◎ | ◎ | ◎ |
| Example 3 | Cyan | ◎ | ◎ | ◎ | ◎ | ◎ |
| Example 4 | Yellow | ◎ | ◎ | ◎ | ◎ | ◎ |
| Example 5 | Magenta | ○ | ◎ | ○ | ◎ | ○ |
| Example 6 | Magenta | ◎ | ◎ | ◎ | ◎ | ◎ |
| Example 7 | Magenta | ◎ | ◎ | ◎ | ◎ | ◎ |
| Example 8 | Magenta | □ | ◎ | ◎ | ◎ | ◎ |
| Example 9 | Magenta | ◎ | ◎ | ◎ | ◎ | ◎ |
| Example 10 | Magenta | ○ | ◎ | ◎ | ◎ | ◎ |
| Example 11 | Magenta | □ | ○ | □ | ○ | □ |
| Example 12 | Magenta | ◎ | ◎ | ◎ | ◎ | ◎ |
| Example 13 | Magenta | ◎ | ○ | ○ | ○ | ○ |
| Example 14 | Magenta | ◎ | ◎ | □ | ◎ | □ |
| Comparative Ex. 1 | Magenta | ◎ | ○ | Δ | ○ | Δ |
| Comparative Ex. 2 | Magenta | ◎ | □ | x | □ | x |
| Comparative Ex. 3 | Cyan | ◎ | □ | x | ○ | x |
| Comparative Ex. 4 | Yellow | ◎ | ○ | x | □ | x |
| Comparative Ex. 5 | Magenta | Not available | Not available | Not available | Not available | Not available |

TABLE 2-continued

| | | | | | | |
|---|---|---|---|---|---|---|
| Comparative Ex. 6 | Magenta | □ | ◎ | ○ | ◎ | ◎ |
| Comparative Ex. 7 | Magenta | x | ○ | Δ | ○ | Δ |
| Comparative Ex. 8 | Magenta | x | ○ | □ | ○ | □ |
| Comparative Ex. 9 | Magenta | ○ | ○ | □ | ○ | □ |
| Comparative Ex. 10 | Magenta | Δ | ○ | □ | ○ | □ |
| Comparative Ex. 11 | Magenta | ◎ | □ | □ | □ | □ |
| Comparative Ex. 12 | Magenta | Δ | □ | Δ | □ | Δ |
| Comparative Ex. 13 | Magenta | Δ | □ | Δ | □ | Δ |

| | | | Evaluation 8 Hollow Defects | | Evaluation 9 Transfer Irregularity and White Spots | |
|---|---|---|---|---|---|---|
| | Color | Evaluation 7 Filming Beginning | Beginning | After 50,000 images were produced | Beginning | After 50,000 images were produced |
| Example 1 | Magenta | ◎ | ◎ | ◎ | ◎ | ◎ |
| Example 2 | Magenta | ◎ | ◎ | ◎ | ◎ | ◎ |
| Example 3 | Cyan | ◎ | ◎ | ◎ | ◎ | ◎ |
| Example 4 | Yellow | ◎ | ◎ | ◎ | ◎ | ◎ |
| Example 5 | Magenta | ○ | ◎ | ○ | ○ | □ |
| Example 6 | Magenta | ◎ | ◎ | ◎ | ◎ | ◎ |
| Example 7 | Magenta | ◎ | ◎ | ◎ | ◎ | ◎ |
| Example 8 | Magenta | □ | ◎ | □ | ◎ | □ |
| Example 9 | Magenta | ◎ | ◎ | ○ | ◎ | ○ |
| Example 10 | Magenta | ○ | ◎ | ○ | ◎ | ○ |
| Example 11 | Magenta | □ | ○ | ○ | ○ | ○ |
| Example 12 | Magenta | ◎ | ◎ | ◎ | ◎ | ◎ |
| Example 13 | Magenta | ○ | ◎ | ◎ | ◎ | ◎ |
| Example 14 | Magenta | □ | ◎ | ○ | ◎ | ○ |
| Comparative Ex. 1 | Magenta | ◎ | ◎ | ○ | ◎ | ○ |
| Comparative Ex. 2 | Magenta | □ | ◎ | ○ | ◎ | ○ |
| Comparative Ex. 3 | Cyan | □ | ◎ | ○ | ◎ | ○ |
| Comparative Ex. 4 | Yellow | □ | ◎ | ○ | ◎ | ○ |
| Comparative Ex. 5 | Magenta | Not available | Not available | Not available | Not available | Not available |
| Comparative Ex. 6 | Magenta | ○ | ◎ | ○ | ◎ | ○ |
| Comparative Ex. 7 | Magenta | x | □ | x | □ | x |
| Comparative Ex. 8 | Magenta | x | ○ | Δ | ○ | Δ |
| Comparative Ex. 9 | Magenta | ○ | ○ | Δ | ○ | Δ |
| Comparative Ex. 10 | Magenta | Δ | ○ | Δ | ○ | Δ |
| Comparative Ex. 11 | Magenta | Δ | ◎ | ○ | ○ | Δ |
| Comparative Ex. 12 | Magenta | Δ | □ | x | □ | x |
| Comparative Ex. 13 | Magenta | Δ | □ | x | □ | x |

| | Color | Evaluation 10 Durability | Remarks |
|---|---|---|---|
| Example 1 | Magenta | ◎ | |
| Example 2 | Magenta | ◎ | |
| Example 3 | Cyan | ◎ | |
| Example 4 | Yellow | ◎ | |
| Example 5 | Magenta | ◎ | |
| Example 6 | Magenta | ◎ | |
| Example 7 | Magenta | ◎ | |
| Example 8 | Magenta | □ | |
| Example 9 | Magenta | □ | |
| Example 10 | Magenta | ○ | |

TABLE 2-continued

| | | | |
|---|---|---|---|
| Example 11 | Magenta | ○ | |
| Example 12 | Magenta | ◎ | |
| Example 13 | Magenta | ○ | |
| Example 14 | Magenta | □ | |
| Comparative Ex. 1 | Magenta | ○ | |
| Comparative Ex. 2 | Magenta | □ | |
| Comparative Ex. 3 | Cyan | □ | |
| Comparative Ex. 4 | Yellow | □ | |
| Comparative Ex. 5 | Magenta | Not available | The release agent was dissolved in the binder resin. |
| Comparative Ex. 6 | Magenta | □ | An intertwist of a receiving paper occurred. |
| Comparative Ex. 7 | Magenta | x | |
| Comparative Ex. 8 | Magenta | x | |
| Comparative Ex. 9 | Magenta | x | |
| Comparative Ex. 10 | Magenta | x | |
| Comparative Ex. 11 | Magenta | Δ | |
| Comparative Ex. 12 | Magenta | Δ | |
| Comparative Ex. 13 | Magenta | Δ | |

Having now fully described the invention, it will be apparent to one of ordinary skill in the art that many changes and modifications can be made thereto without departing from the spirit and scope of the invention as set forth therein.

This document claims priority and contains subject matter related to Japanese Patent Application No. 2001-046950 filed on Feb. 22, 2001, the entire contents of which are hereby incorporated herein by reference.

What is claimed as new and desired to be secured by Letters Patent of the United States is:

1. A color toner composition, comprising:

toner particles comprising:

a binder resin; and a colorant and a release agent dispersed in the binder resin, and 0.3 to 1.5 parts by weight of titania having a primary particle diameter of 0.005 to 0.02 μm as an external additive, wherein the colorant has an average dispersion particle diameter not greater than 0.5 μm;

the release agent and the binder resin are insoluble to each other;

the toner particles satisfy the following relationship:

$$0.05 \leqq Dw/D_4 \leqq 0.4,$$

wherein Dw represents an average dispersion particle diameter of the release agent and $D_4$ represents a weight-average particle diameter of the toner particles; and the titania has a segregation rate of from 0.5 to 5%.

2. The color toner composition of claim 1, wherein relationship $$D_4/Dn \leqq 1.3$$

is satisfied, wherein $D_4$ represents the weight-average particle diameter of the toner particles and the Dn represents a number-average particle diameter of the toner particles.

3. The color toner composition of claim 1, wherein the release agent is one of polyolefin waxes and carnauba waxes which are subjected to a treatment of eliminating free fatty acid therefrom.

4. The color toner composition of claim 1, wherein the release agent has a melting point of from 85 to 95° C. and a ratio (Mw/Mn) of a weight-average molecular weight (Mw) to a number-average molecular weight (Mn) of from 1.0 to 1.2.

5. The color toner composition of claim 1, wherein the titania has an average primary particle diameter of from 0.002 μm to 0.03 μm.

6. The color toner composition of claim 1, wherein the binder resin has a softening point of from 80 to 110° C.

7. The color toner composition of claim 1, wherein the binder resin comprises at least one of a polyester resin and a polyol resin.

8. The color toner composition of claim 1, wherein the toner particles further comprise a charge controlling agent, and wherein the charge controlling agent comprises a metallic salt of salicylic acid derivatives.

9. A method for manufacturing a color toner composition, comprising:

kneading a first part of a binder resin, a colorant, and water upon application of heat to prepare a master batch pigment;

kneading a second part of the binder resin, a release agent that is insoluble in the binder resin, and the master batch pigment upon application of heat to prepare a mixture;

pulverizing the mixture to prepare a color toner, mixing the color toner with 0.3 to 1.5 parts by weight of titania having a primary particle diameter of 0.005 to 0.02 μm using a mixer having a mixing blade, for not less than 50 sec, to obtain a color toner composition which comprises toner particles comprising:

said binder resin; and said colorant and said release agent dispersed in the binder resin, and said 0.3 to 1.5 parts by weight of titania having a primary particle diameter of 0.005 to 0.02 μm as an external additive, wherein the colorant has an average dispersion particle diameter not greater than 0.5 μm;

the release agent and the binder resin are insoluble in each other;

the toner particles satisfy the following relationship:

$$0.05 \leqq Dw/D_4 \leqq 0.4,$$

wherein Dw represents an average dispersion particle diameter of the release agent and $D_4$ represents a weight-average particle diameter of the toner particles; and the titania has a segregation rate of from 0.5 to 5%.

10. The method of claim 9, wherein the mixing blade has an end peripheral velocity of from 15 to 35 m/sec.

11. A two-component developer comprising the color toner composition of claim 1 and a carrier.

12. A container containing the color toner composition of claim 1.

13. A container containing the two-component developer of claim 11.

14. An image forming method comprising:

forming at least one electrostatic latent image on a latent-image bearer;

developing the electrostatic latent image with at least one color developer comprising a color toner to form a color toner image on the latent-image bearer;

transferring the toner image onto a transfer sheet optionally via an intermediate transfer medium, wherein the color toner comprises toner particles comprising:

a binder resin; and a colorant and a release agent dispersed in the binder resin, and 0.3 to 1.5 parts by weight of titania having a primary particle diameter of 0.005 to 0.021 μm as an external additive, wherein the colorant has an average dispersion particle diameter not greater than 0.5 the release agent and the binder resin are insoluble to each other;

the toner particles satisfy the following relationship:

$$0.05 \leqq Dw/D_4 \leqq 0.4,$$

wherein Dw represents an average dispersion particle diameter of the release agent and $D_4$ represents a weight-average particle diameter of the toner particles; and the titania has a segregation rate of from 0.5 to 5%.

15. The image forming method of claim 14, wherein transferring the toner image onto a transfer sheet transfers the toner image through an intermediate transfer medium.

* * * * *